US008127945B2

(12) United States Patent
Nguy et al.

(10) Patent No.: US 8,127,945 B2
(45) Date of Patent: Mar. 6, 2012

(54) VERTICAL TOOL STORAGE DEVICE

(75) Inventors: Chanwa Nguy, Cornelius, NC (US); Pei-Ying Lin, Taichung Hsien (TW)

(73) Assignee: Steelworks Hardware, LLC, Northbrook, IL (US)

( * ) Notice: Subject to any disclaimer, the term of this patent is extended or adjusted under 35 U.S.C. 154(b) by 0 days.

(21) Appl. No.: 12/852,154

(22) Filed: Aug. 6, 2010

(65) Prior Publication Data

US 2011/0036790 A1 Feb. 17, 2011

Related U.S. Application Data

(62) Division of application No. 10/555,211, filed as application No. PCT/US2005/039402 on Oct. 26, 2005, now Pat. No. 7,780,017.

(30) Foreign Application Priority Data

Oct. 26, 2004 (CN) ..... 93 1 32336

(51) Int. Cl.
*A47F 7/00* (2006.01)

(52) U.S. Cl. ..... 211/70.6

(58) Field of Classification Search ..... 211/70.6, 211/13.1, 183, 10, 69; 206/372, 373; 220/4.22–4.24
See application file for complete search history.

(56) References Cited

U.S. PATENT DOCUMENTS

| | | | | |
|---|---|---|---|---|
| 284,090 | A | 8/1883 | Tingle | |
| 496,173 | A | 4/1893 | Smith | |
| 2,633,997 | A | 4/1953 | Johnson | |
| 2,650,717 | A | 9/1953 | Larson | |
| 2,692,689 | A | 10/1954 | Wynne | |
| 3,197,034 | A | 7/1965 | Deadrick | |
| 3,317,076 | A * | 5/1967 | Enders | 220/840 |
| 3,517,824 | A | 6/1970 | Paque | |
| 3,648,892 | A | 3/1972 | Morgan | |
| 3,913,711 | A * | 10/1975 | Schmid | 190/16 |
| 3,957,159 | A | 5/1976 | Radek | |
| 5,267,668 | A * | 12/1993 | Jones | 220/326 |
| 5,318,189 | A | 6/1994 | Lee | |
| 5,746,334 | A | 5/1998 | Brandenberg | |
| 5,799,787 | A | 9/1998 | Talbot | |
| 5,984,411 | A | 11/1999 | Galumbeck | |
| 5,996,819 | A | 12/1999 | Klein | |
| 6,158,360 | A | 12/2000 | Cheng | |
| 6,234,287 | B1 * | 5/2001 | Pfeiffer | 190/123 |

(Continued)

FOREIGN PATENT DOCUMENTS

DE 29823041 3/1999

(Continued)

OTHER PUBLICATIONS

Supplementary Search Report for EP Patent Application No. 05824769.3 dated Feb. 23, 2009.

(Continued)

*Primary Examiner* — Jennifer E. Novosad
(74) *Attorney, Agent, or Firm* — Levenfeld Pearlstein, LLC

(57) ABSTRACT

Disclosed is a vertical tool rack storage device which includes a hollow upright pivot shaft, a plurality of flat tool racks for holding tool bits and parts, and a plurality of connectors for pivotally coupling the flat tool racks to the hollow upright pivot shaft for enabling the tool racks to be arranged in a stack and individually turnable about the hollow upright pivot shaft.

6 Claims, 19 Drawing Sheets

U.S. PATENT DOCUMENTS

| | | | | |
|---|---|---|---|---|
| 6,267,238 | B1 * | 7/2001 | Miller et al. | 206/349 |
| 6,425,490 | B1 | 7/2002 | Ta | |
| 6,431,373 | B1 | 8/2002 | Blick | |
| 6,443,260 | B1 * | 9/2002 | Katz et al. | 182/129 |
| D471,358 | S | 3/2003 | Yang | |
| D471,359 | S | 3/2003 | Yang | |
| 6,568,546 | B1 | 5/2003 | Huang | |
| 6,705,655 | B2 | 3/2004 | Yang | |
| 6,789,670 | B2 * | 9/2004 | Cooper et al. | 206/349 |
| 6,796,443 | B2 | 9/2004 | Lippman | |
| 6,808,077 | B2 | 10/2004 | McConnell | |
| D505,548 | S | 5/2005 | Yang | |
| 6,971,517 | B2 * | 12/2005 | Chen | 206/372 |
| D541,612 | S | 5/2007 | Lin | |
| 7,559,427 | B2 * | 7/2009 | Hu | 206/764 |
| 2003/0221984 | A1 * | 12/2003 | Huang | 206/372 |
| 2004/0035748 | A1 * | 2/2004 | Hernandez et al. | 206/748 |
| 2004/0144671 | A1 * | 7/2004 | Hallee et al. | 206/373 |
| 2005/0247586 | A1 * | 11/2005 | Chen | 206/372 |
| 2007/0102381 | A1 | 5/2007 | Nguy | |
| 2008/0041799 | A1 | 2/2008 | Nguy | |
| 2008/0061020 | A1 | 3/2008 | Kaisler | |
| 2008/0197131 | A1 | 8/2008 | Lin | |
| 2009/0020489 | A1 | 1/2009 | Lin | |
| 2009/0114783 | A1 | 5/2009 | Lin | |

FOREIGN PATENT DOCUMENTS

| | | |
|---|---|---|
| EP | 1520729 | 4/2005 |
| EP | 1547730 | 6/2005 |

OTHER PUBLICATIONS

International Search Report Issued in Connection with PCT/US2005/039402 on May 4, 2006.

* cited by examiner

Fig. 12A
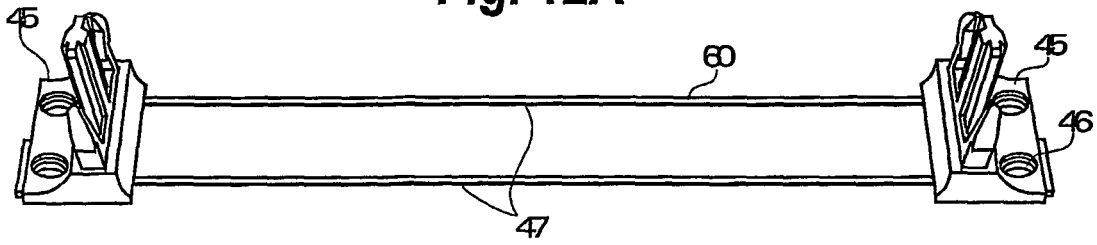
Fig. 12B
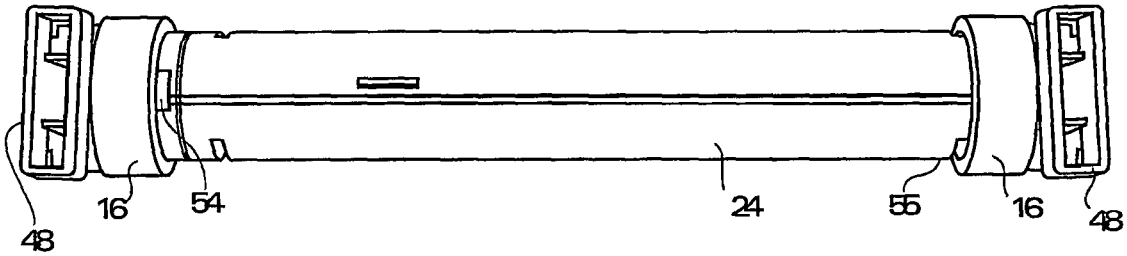
Fig. 13
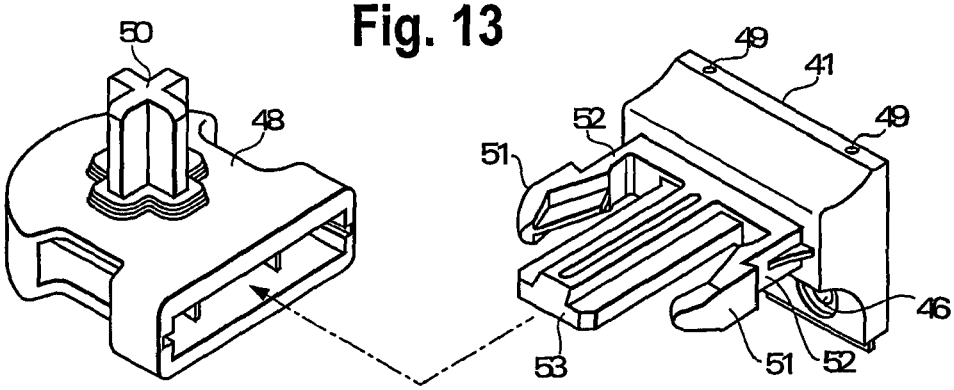
Fig. 14
Fig. 15
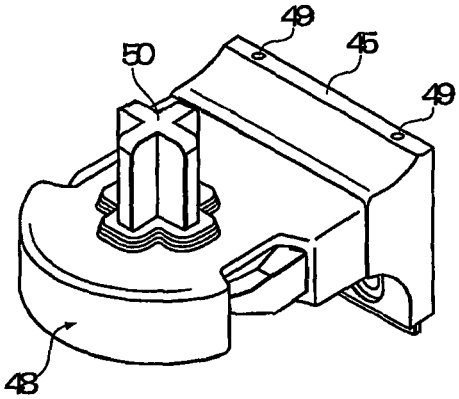
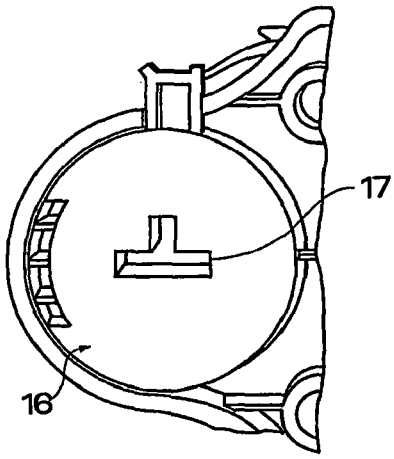

VERTICAL TOOL STORAGE DEVICE

CROSS-REFERENCE TO RELATED APPLICATION DATA

This application is a divisional application of U.S. patent application Ser. No. 10/555,211, filed Jun. 15, 2007.

FIELD OF INVENTION

This application claims the benefit of the Republic of China (Taiwan) Application No. 93132336, filed on Oct. 26, 2004.

The present invention relates to a vertical tool rack storage device for large hand tools such as pliers, screwdrivers, wrenches and related tools, and also for small items such as tool bits and related articles. The device comprises a hollow upright pivot shaft having a top end and a bottom end; optionally, both ends are end capped. A plurality of connectors are mounted on the hollow upright pivot shaft and a plurality of tool racks are coupled to the connectors.

BACKGROUND AND RELATED ART

A variety of tool cases and racks have been disclosed. The present invention provides a versatile, mobile, vertical tool rack storage device wherein tool racks are coupled to coupling rings, which are mounted on the hollow upright pivot shaft. At least one tool rack is coupled to connectors, which are mounted on the hollow upright pivot shaft. Usually, three tool racks are coupled to connectors. The prior art has not contemplated hollow upright pivot shafts on which one to three racks are coupled through connectors. As background, the following references are discussed:

U.S. Pat. No. 6,705,655,132 to Yang discloses a tool rack having stacked racks having integral collars that pivot on a common shaft.

U.S. Pat. No. 6,796,443 to Lippman discloses a central post member that holds containers via a sleeve. The containers vary in shape and size.

U.S. Pat. No. 3,957,159 to Radek discloses a rotary storage unit on a central post member.

U.S. Pat. No. 5,996,819 to Klein discloses a rotary storage unit on a central post member. There are sleeves mounted on the post member providing a swivel rotation.

U.S. Pat. No. 6,808,077 to McConnell discloses a tool organizer on a rotating tool mount.

U.S. Pat. No. 5,984,411 to Stokhuijzen discloses a hook type closing and rotating holder.

U.S. Pat. No. 5,799,787 to Talbot discloses a central vertical member with rotating storage trays.

Optionally, to assist the craftsman to hang the vertical tool rack storage device of this invention on a wall, the two ends of the hollow upright pivot shaft are end capped at both ends. Each end cap has a coupling wall and a plughole formed in the wall; a plurality of detachable connecting structures are provided, each having a plug rod attached to each end cap through the plughole. Furthermore, a plurality of fastening structures are provided comprising a base having a plurality of apertures for fastening to an upright support structure. Each fastening structure comprises a coupling unit detachably connected to the connecting structure at the top and bottom ends of the capped pivot structure.

SUMMARY OF THE INVENTION

A novel vertical tool rack storage device is provided for storing small or large tools on racks.

The vertical tool rack storage device comprises a hollow upright pivot shaft having two ends, a top end and a bottom end. A plurality of connectors are adapted to pivotally connect at least one tool rack to the hollow upright pivot shaft. Each connector comprises a coupling ring pivotally connectable to the hollow upright pivot shaft. The vertical tool rack storage device also comprises one flat arm for carrying one tool rack. Usually, three flat arms are utilized carrying three tool racks. A neck radially extends from the periphery of the coupling ring and is terminating at one end of the flat arm. Suitably, a first ridged portion is transversely provided at one end of the flat arm and is connected to the neck. A second ridged portion is transversely provided at an opposite end of said flat arm and is defined with said first ridged portion and second flat arm a space for accommodating the tool rack.

BRIEF DESCRIPTION OF THE FIGURES

FIG. 12A shows detachable connecting and detachable fastening structures. In FIG. 12A the structures are connected by two wires.

FIG. 12B shows the structures connected to the hollow tube through the end cap. The coupling rings are not attached to the hollow upright tube in this figure and, therefore, also the connectors and tool racks are not shown.

FIG. 13 illustrates the detachable connecting structures and the detachable fastening structures as separate components.

FIG. 14 illustrates the connecting structure and fastening structure combined as one unit.

FIG. 15 illustrates either the top or the bottom of the end cap of the hollow upright pivot shaft showing the plug though which a plug rod of the connecting structure is attached to the end cap. The plug hole can be as shown or can be in the form of a cross.

FIG. 18 has been intentionally omitted.

DETAILED DESCRIPTION OF THE INVENTION

Figure 1:
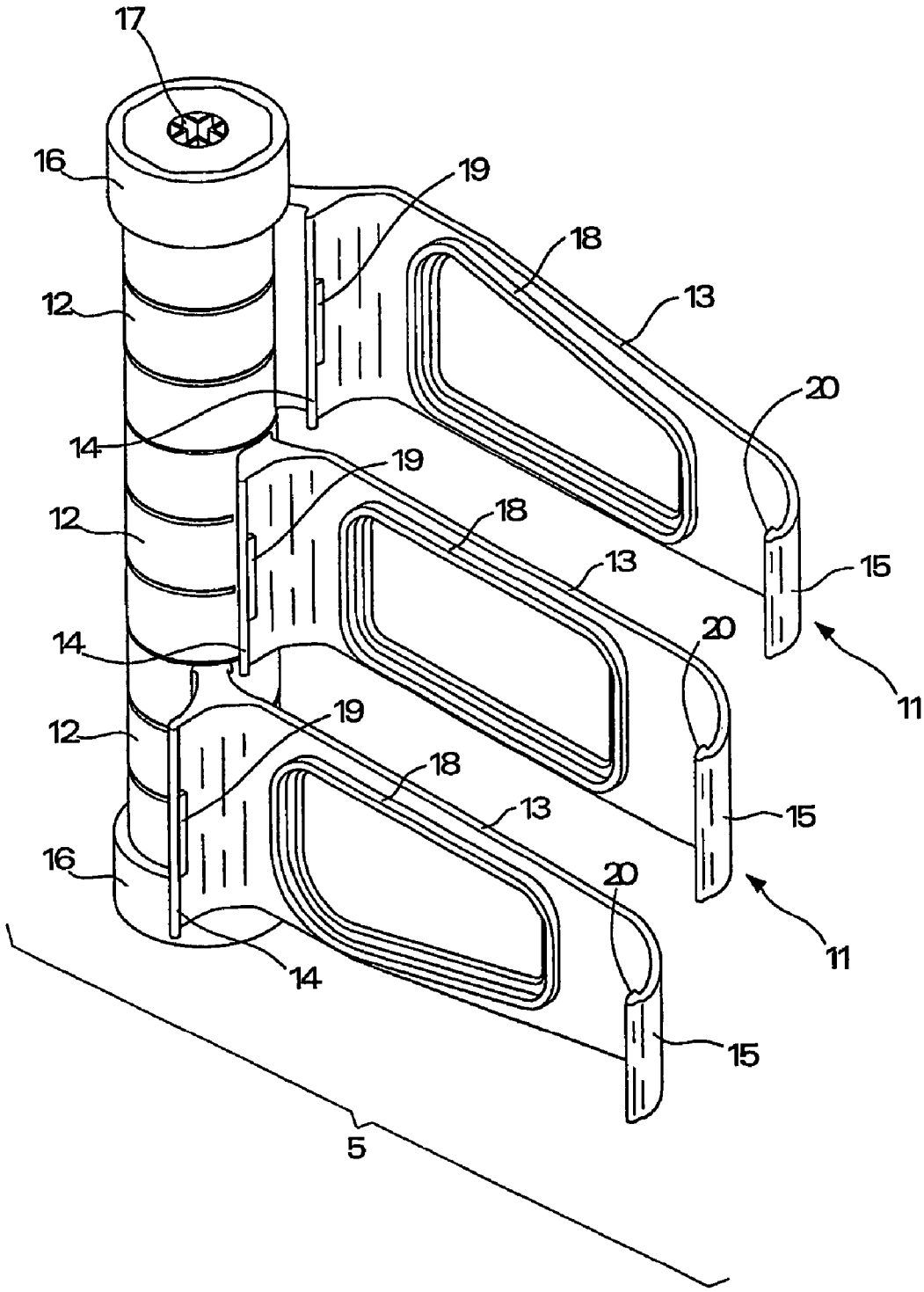
FIG. 1 illustrates the vertical tool rack storage device of this invention including a plurality of connectors coupled to a hollow upright pivot shaft according to the present invention.

The present invention relates to a vertical tool rack storage device. The vertical tool rack storage device comprises a hollow upright pivot shaft having two ends, a top end and a bottom end. The hollow upright pivot shaft is end capped on the top end and the bottom end. A plurality of connectors is adapted to pivotally connect at least one tool rack, usually three, to the hollow upright pivot shaft. Each connector comprises a coupling ring pivotally connectable to the upright hollow pivot shaft. A flat arm is provided for each tool rack. A neck is radically extended from the periphery of the coupling ring and is terminating at one end of the flat arm. A first ridged portion is transversely provided at one end of the flat arm and is connected to the neck. A second ridged portion is transversely provided at an opposite end of said flat arm and is defining with the first ridged portion and the flat arm a space for accommodating a tool rack.

The vertical tool rack storage device of this invention has a plurality of connectors wherein each connector further comprises a first locating rib and a second locating rib provided at the first ridged portion and the second ridged portion. Each tool rack comprises a plurality of locating grooves provided at two opposite peripheral walls thereof for receiving the first locating rib and the second locating rib of each said connector.

The vertical tool rack storage device of this invention has tool racks wherein each said tool rack comprises a plurality of endless positing grooves provided at a bottom wall thereof. Each connector comprises an endless protruding position portion provided at the flat arm thereof for engaging one endless positioning groove of each said tool rack.

The coupling ring of each connector comprises a plurality of locating grooves equiangularly spaced around an inside wall thereof and extending in an axial direction. The hollow upright pivot shaft comprises a plurality of spring strips axially aligned in a line, each said spring strip having a fixed and formed integral with the peripheral of the hollow upright pivot shaft and a free end provided with a raised portion for selectively engaging one of the locating grooves of the coupling ring of each said connector.

It is further provided the coupling ring of each connector further comprises a rib spaced between two of and in line with said spring strips for engaging one locating groove in the coupling ring of one said connector to stop the respective connector from turning about said hollow upright pivot shaft.

A coupling structure is provided for coupling each two of said at least one tool rack together. The coupling structure is designed for allowing the two coupled tool racks to be turned relative to each other between an open position and a close portion. The coupling structure comprises a first recessed portion and a second recessed portion respectively provided at the border of one said of each said tool rack. A retaining block is disposed in said first recessed portion and a swinging returning ring is extending from said second recessed portion in such a manner that the swinging retaining ring at one tool rack can be hooked on the retaining block in the first recessed portion at another tool rack.

A locking structure is also provided for locking each two of said at least one tool rack that have been fastened together by set in the close portion. The locking structure comprises a male locking member and a female locking member respectively provided at two opposite sides of each said tool rack for enabling two of said at least one tool rack to be locked in the close position by fastening the male locking member of one tool rack to the female locking member of the other tool rack. Initially the male locking member is a retaining block, and the female locking member is a swinging ring.

The vertical tool rack storage device of this invention comprises tool racks wherein each tool rack has a recessed area in a bottom wall wherefrom a plurality of protruding portions spaced from one another in said recessed areas and a plurality of finger grooves formed in said recessed area and separated from one another by said protruding portions.

Each tool rack has at least one recessed locating hole and at least one raised locating portion arranged in a top wall thereof in such a manner to enable a plurality of tool racks to be attached together by engaging the at least one raised locating portion at the tool rack into the at least one recessed locating aperture at the other tool rack. Optimally each tool rack has at least one hanging aperture for hanging.

The vertical tool rack storage device of this invention comprises two flat independent tool racks for holding tool bits and parts; a coupling structure for securing said to flat independent tool racks for allowing said two flat independent tool racks to be turned relative to each other between an open position and close position; and a locking structure for locking said two flat independent tool racks is said close position.

The coupling structure comprises a first recessed portion and a second recessed portion respectively provided at the border of one side of each said flat independent tool rack. A retaining block is disposed in said flat recessed portion and a swinging retaining ring is extending from said recessed portion in such a manner that the swinging retaining ring at one said flat independent tool rack can be hooked into the retaining block in the first recessed portion at the other flat independent tool rack. Advantageously the locking structure comprises a male locking member and a female locking member respectively provided at two opposite ends of each said flat independent tool rack for enabling said two independent tool racks to be locked in said close position by fastening the male locking member at one of said two flat independent tool racks to the female locking member at the other of said two flat independent tool racks. Preferably the male locking member is a retaining block and said female locking member is a swinging ring.

Each flat independent tool rack has a recessed area in a bottom wall thereof, a plurality of protruding portions spaced from one another in said recessed areas, and a plurality of finger grooves formed in said recessed area and separated from one another by said protruding portions.

Suitably, each flat independent tool rack has at least one recessed locating hole and at least one raised locating portion arranged in a top wall thereof so said flat independent tool racks can be attached together by engaging the at least one raised locating portion at one of said flat independent tool racks.

Suitably, a vertical tool rack storage device comprises a hollow upright pivot shaft having two ends, a top end and a bottom end, the hollow upright pivot shaft is end capped on the top end and the bottom end.

The vertical tool rack storage device comprises a plurality of tool racks, each said tool rack comprising a plurality of compartments for holding tool bits and parts, two locating grooves provided at two opposite peripheral walls thereof, and an endless positioning groove provided at a bottom wall thereof; and a plurality of connectors adapted to pivotally connect said tool racks to said hollow upright pivot shaft, each said connector comprising a coupling ring pivotally connectable to said hollow upright pivot shaft, suitably a flat arm for carrying said tool rack is provided. Furthermore, a neck is radially extended from the periphery of said coupling ring and terminating at one end of said flat arm. A first ridged portion is transversely provided at one end of said flat arm and connected to said neck, a second ridged portion transversely provided at an opposite end of said flat arm and defining with said first ridged portion and said flat arm a space for accommodating one tool rack. Two ribs are provided at said first ridged portion and said second ridged portion and adapted to engage the locating grooves of the tool rack placed on said flat arm, and a protruding positioning portion provided at said flat arm for engaging one endless positioning groove of the tool rack placed on said flat arm. The coupling ring of each said connector comprises a plurality of locating grooves equiangularly spaced around an inside wall thereof and extending in axial direction; said hollow upright pivot shaft comprises a plurality of spring strips axially aligned in a line each said spring having a fixed end formed integral with the peripheral wall of said pivot shaft and a free end provided with a raised portion for selectively engaging one of the locating grooves of the coupling rind of each said connector.

Advantageously a vertical tool rack storage device is comprising a hollow upright pivot shaft having two ends, a top end and a bottom end, the hollow upright pivot shaft is end capped on the top end, each end cap has a coupling wall and a plug hole formed in the coupling wall.

The vertical tool rack storage device has a plurality of connectors adapted to pivotally connect said at least one tool rack to said hollow upright pivot shaft. Each connector comprises a coupling ring pivotally connectable to said hollow upright pivot shaft. A flat arm for carrying one said tool rack is provided.

A neck is radially extended from the periphery of said coupling ring and terminating at one end of said flat arm. A first ridged portion is transversely provided at one end of said flat arm and is connected to said neck. A second ridged portion is transversely provided at an opposite end of said flat arm and defining with said first ridged portion and said flat arm in space for accommodating one tool rack. Each connector further comprises a first locating rib and a second locating rib respectively provided at said first ridged portion and said second ridged portion. Each tool rack comprises a plurality of locating grooves respectively provided at two opposite peripheral walls thereof for receiving the first locating rib and second locating rib of each said connector.

Each tool rack comprises a plurality of endless positioning grooves provided at a bottom wall thereof; each said connector comprises an endless protruding positioning portion provided at the flat arm thereof for engaging one endless positioning groove of each said tool rack. The coupling ring of each connector comprises a plurality of locating grooves equiangularly spaced around an inside wall wherefrom they extend in axial direction. The hollow upright pivot shaft comprises a plurality of spring strips axially aligned in a line, each said spring strip having a fixed end formed integral with the peripheral wall of said hollow upright pivot shaft and a free end provided with a raised portion for selectively engaging one of the locating grooves of the coupling ring of each connector.

The coupling ring of each connector comprises a rib spaced between two of and in line with the spring strips for engaging one locating groove in the coupling ring of one said connector to stop the respective connector from turning about said hollow upright pivot shaft.

The vertical tool rack storage device of this invention further comprising a coupling structure for coupling each two of said at least one tool rack together, and allowing the two coupled tool racks to be turned relative to each other between an open position and a closed position. The coupling structure comprises a first recessed portion and a second recessed portion respectively provided at the border of one side of each said tool rack. A retaining block is disposed in said first recessed portion and a swinging retaining ring is extending from said second recessed portion in such a manner that the swinging retaining ring at one tool rack can be hooked on the retaining block in the first recessed portion at another tool rack.

A locking structure is provided for locking each two of said at least one tool rack that have been fastened together in the close position. The locking structure comprises a male locking member and a female locking member respectively provided at two opposite sides of each said tool rack for fastening two of said at least one tool rack to be locking in the close position by fastening the male locking member at one tool rack to the female locking member at the other tool rack. Suitably the male locking member is a retaining block and the female locking member is a swinging ring.

In the vertical tool rack storage device of this invention each tool rack has at least one recessed locating aperture and at least one raised locating portion arranged in a top wall thereof in such a manner to enable a plurality of tool racks to be attached together by engaging the at least one raised locating portion at one tool rack into the at least one recessed locating hole at the other tool rack.

In another embodiment of the vertical tool rack storage device of this invention connecting and fastening structures are attached to the end caps which enable the vertical tool rack storage device to be handed on a wall.

The vertical tool rack storage device comprises:

(a) A hollow upright pivot shaft having two ends, a top end and a bottom end;
(b) the hollow upright pivot shaft end capped on the top end and the bottom end;
(c) each end cap having a coupling wall and a plug hole formed in the wall;
(d) a plurality of detachable connecting structures each having a plug rod attached to each end cap through the plug hole;
(e) a plurality of fastening structures comprising a base having a plurality of apertures for fastening to an upright support structure;
(f) each fastening structure comprising a coupling unit detachably connected to the connecting structure at the top and bottom ends of the capped hollow upright pivot shaft;
(g) at least one tool rack for holding tool bits and parts;
(h) a plurality of connectors adapted to pivotally connect said at least one tool rack to said hollow upright pivot shaft, each said connector comprising a coupling ring pivotally connectable to said hollow upright pivot shaft; and (i) a flat arm for carrying one said tool rack, a neck radially extended from the periphery of said coupling ring and terminating at one end of said flat arm, a first ridged portion transversely provided at one end of said flat arm and connected to said neck, and a second ridged portion transversely provided at an opposite end of said flat arm and defining with said first ridged portion and said flat arm a space for accommodating one tool rack.

Each connector further comprises first locating rib and a second locating rib respectively provided at said first ridged portion and said second ridged portion; each said tool rack comprises a plurality of locating grooves respectively provided at two opposite peripheral walls thereof for receiving the first locating rib and second locating rib of each said connector. Each tool rack comprises a plurality of endless positioning grooves provided at a bottom wall thereof; each said connector comprises an endless protruding positioning portion provided at the flat arm thereof for engaging one endless positioning groove of each said tool rack. The coupling ring of each said connector comprises a plurality of locating grooves equiangularly spaced around an inside wall thereof and extending in axial direction; said hollow upright pivot shaft comprises a plurality of spring strips axially aligned in a line, each said spring strip having a fixed and formed integral with the peripheral wall of said hollow upright pivot shaft and a free end provided with a raised portion for selectively engaging on of the locating grooves of the coupling ring of each said connector. The coupling ring of each said connector further comprises a rib spaced between two of and in line with said spring strips for engaging one locating groove in the coupling ring of one said connector to stop the respective connector from turning about said hollow upright pivot shaft.

The vertical tool rack storage device of this invention comprises a coupling structure for coupling each two of said at least one tool rack together, for allowing the two coupled tool racks to be turned relative to each other between an open position and a close position.

The coupling ring comprises a first recessed portion and a second recessed portion respectively provided at the border of one said of each said tool rack, a retaining block disposed in said first recessed portion, and a swinging retaining ring extending from said second recessed portion in such a manner that the swinging retaining ring at one tool rack can be hooked on the retaining block in the first recessed portion at another tool rack.

The vertical tool rack storage device of this invention is provided with a locking structure for locking each two of said at least one tool rack that have been fastened together by set in the close position. The locking structure comprises a male locking member and a female locking member respectively provided at two opposite ends of each said tool rack for enabling two of said at least one tool rack to be locked in the close position by, fastening the male locking member at one tool rack to the female locking member at the other tool rack. Suitably, the male locking member is a retaining block and the female locking member is a swinging ring.

The vertical tool rack storage device of this invention wherein each said tool rack has a recessed area in a bottom wall thereof, a plurality of protruding portions spaced from one another in said recessed area, and a plurality of finger grooves formed in said recessed area and separated from one another by said protruding portions.

Advantageously, each said tool rack has at least one recessed locating hole and at least one raised locating portion arranged in a top wall thereof in such a manner to enable a plurality of tool racks to be attached together by engaging the at least one raised locating portion at one tool rack into the at least one recessed locating hole at the other tool rack.

Figure 2:
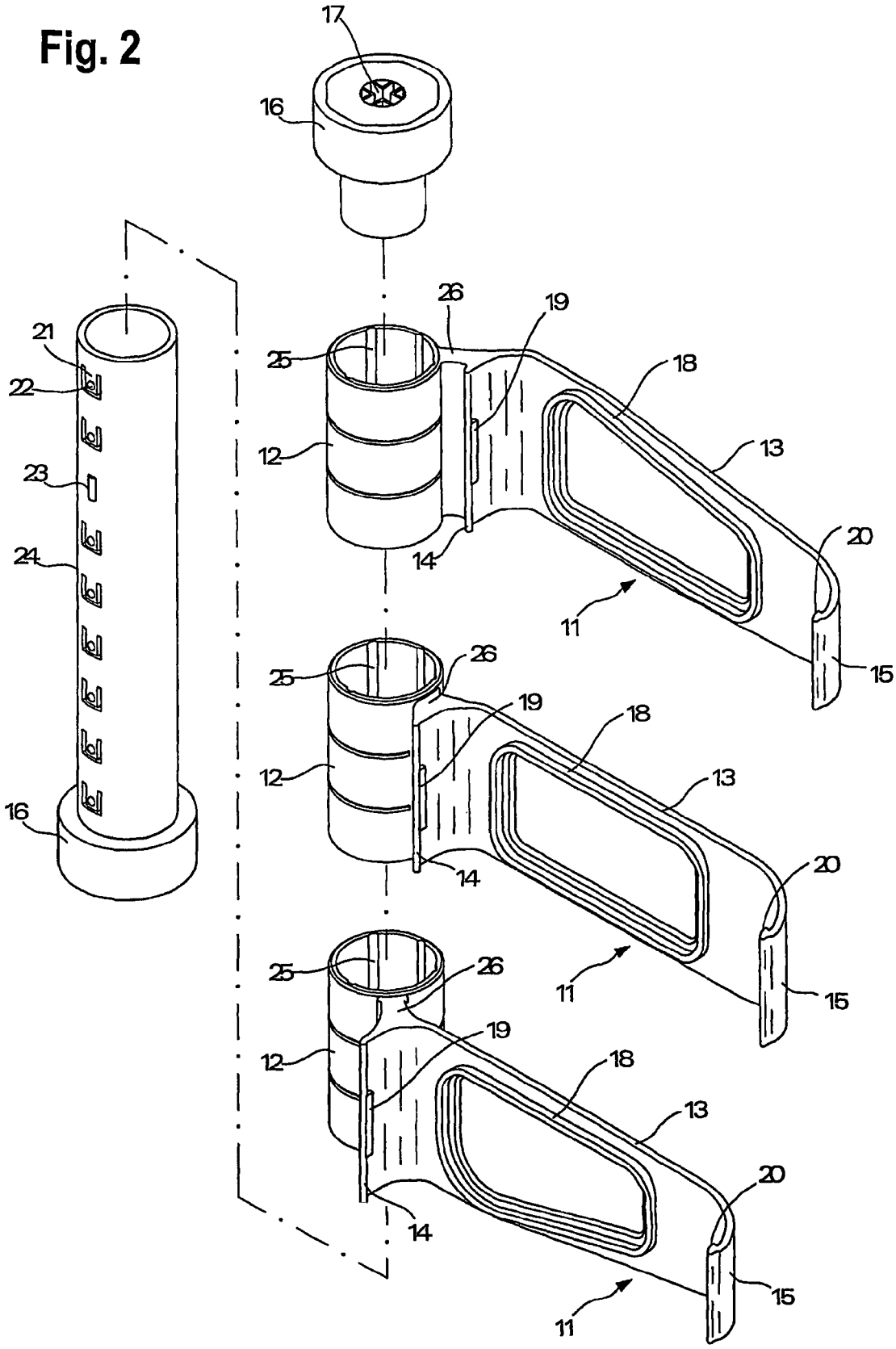
FIG. 2 is an exploded view of the assembly shown in FIG. 1.

FIGS. 1 and 2 illustrates a plurality of connectors (11) coupled to a hollow upright pivot shaft (24). FIG. 2 is an exploded view of the assembly shown in FIG. 1. The coupling ring (12) of each of a number of connectors (11) is respectively coupled to a hollow upright pivot shaft (24) to pivotally connect a number of tool racks (10).

After coupling of the coupling rings (12) of the connectors (11) to the hollow upright pivot shaft (24) two end caps (16) are respectively capped on the two ends of the hollow upright pivot shaft. Each end cap (16) has an extended plughole (17) for fastening to the hollow upright support shaft to hold the whole assembly of the tool rack storage device in the upright position. FIGS. 1 and 2 also illustrate the first ridged portion (16), the flat arm (13), the second ridged portion (15) the second locating rib (20), spring strips (21). The free end provided with a raised portion (22) one rib (23), locating grooves (25) and neck (26).

Figure 3:
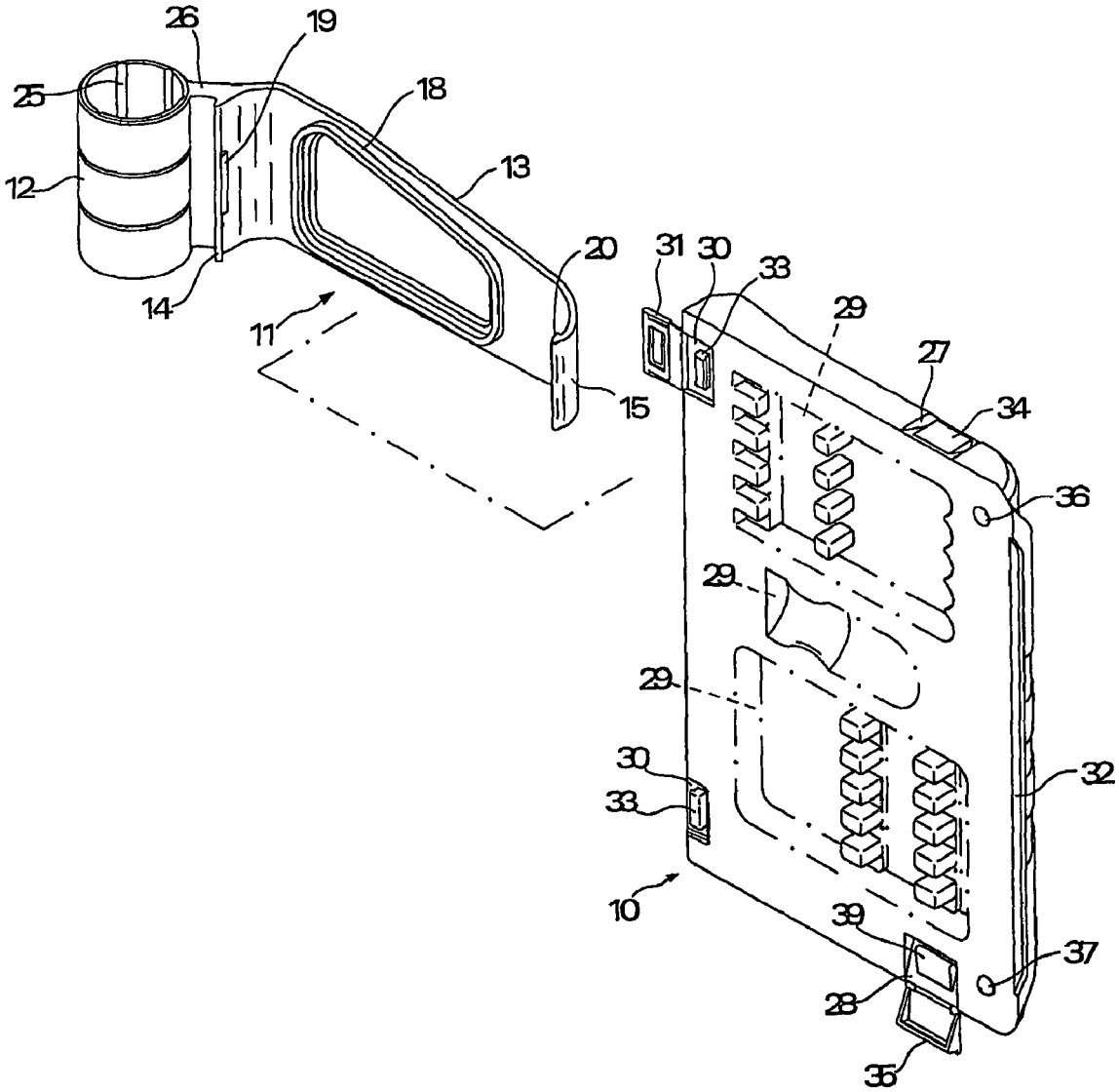
FIG. 3 is an exploded view of a part of the present invention, showing the relationship between a connector and a tool rack.
Figure 4:
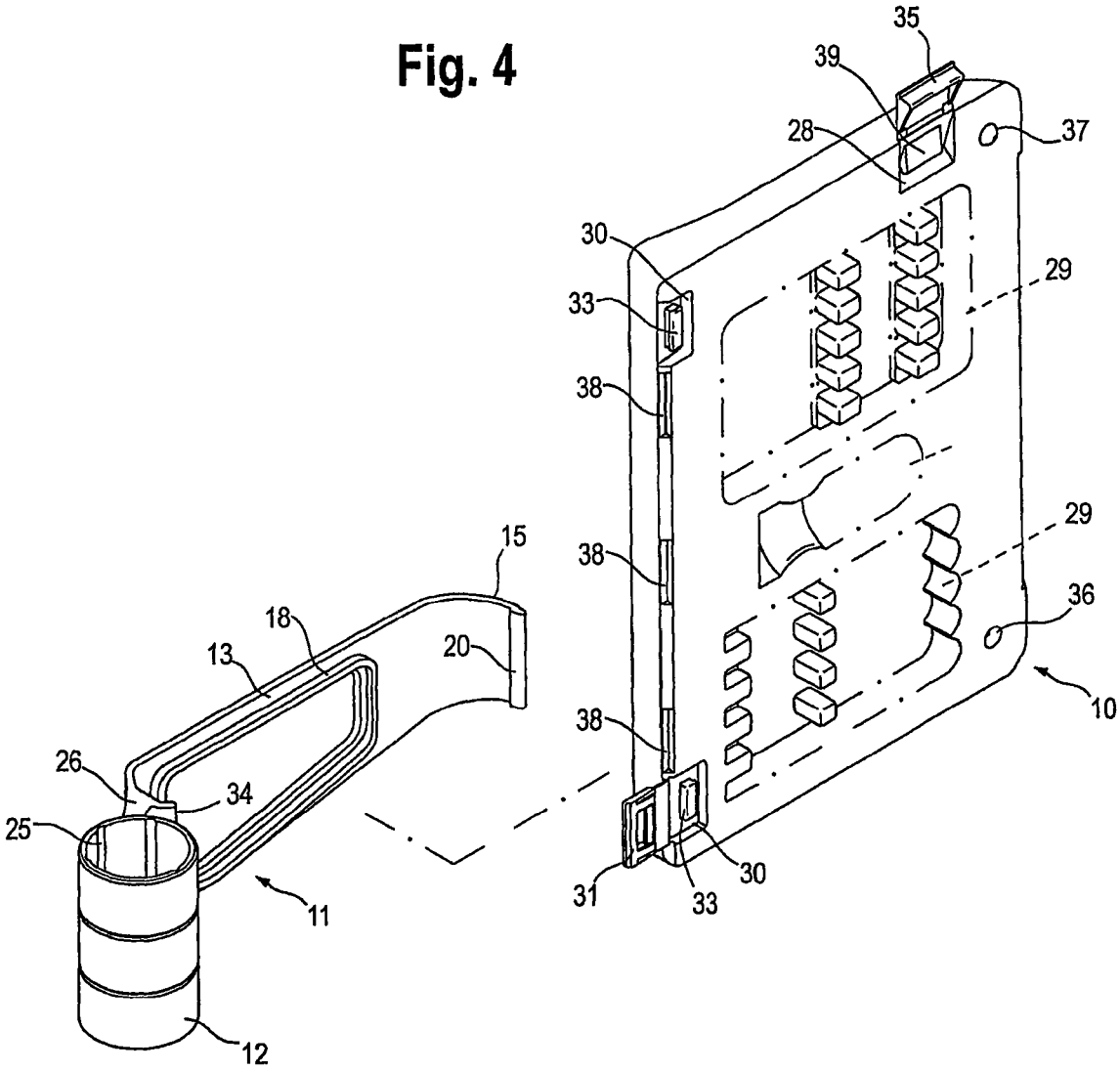
FIG. 4 is similar to FIG. 3 but viewed from another angle.

FIGS. 3 and 4 show a connector (11) detachably connected to a tool rack (10). The connectors (11) comprises a coupling ring (12) a flat arm (13), a neck (26) radially extended from the periphery of the coupling ring (12) and terminating at one end of the flat arm (13), a first ridged portion (14) transversely provided at one end of the flat arm (13) and defining with the first ridged portion (14) and the flat arm (15), a space for accommodating the tool rack (10).

In order to hold the tool rack (10) steadily on the flat arm (13) between the first ridged portion (14) and the second ridged portion (15), a positioning structure is provided. This positioning structure comprises a first locating rib (19) and a second locating rib (20) respectively provided at the connector (11) and extending along the length of the first ridged portion (14) and the second ridged portion (15). A plurality of locating grooves (38) and (32) are provided at the opposite peripheral walls of the tool rack (10) for receiving locating ribs (19) and (20).

FIGS. 3 and 4 also illustrate a raised locating portion (37), locating grooves (32), a recessed locating hole (36), a retaining block (34), a recessed portion (27), a plurality of tool bit compartments, retaining blocks, a plurality of recessed portions (30), swing retaining ring (31), endless protruding portion (18), locating grooves (25), endless positioning grooves (39), recessed portion (28), a female locking member, a swinging retaining ring (35) and locating grooves (38).

Figure 5:
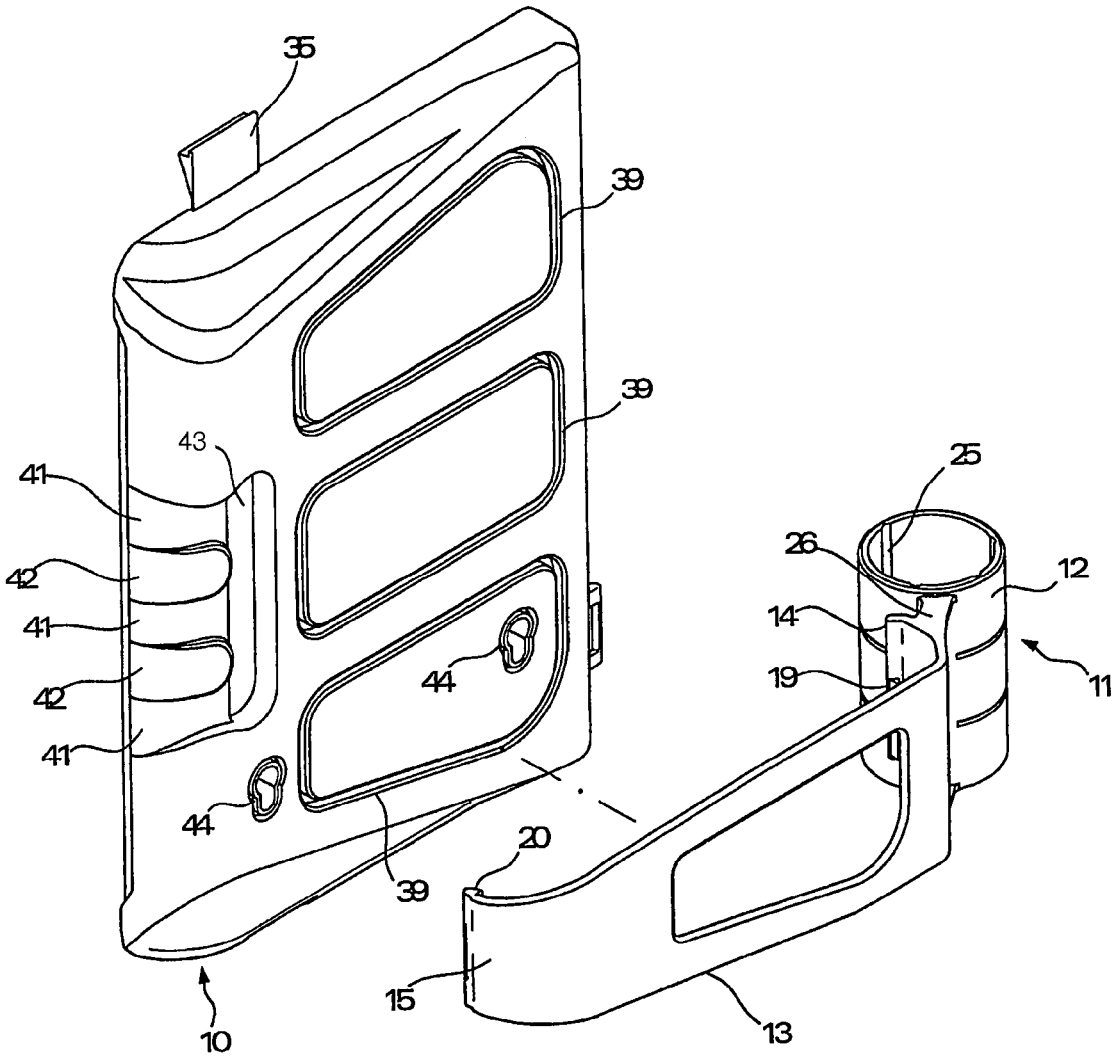
FIG. 5 is a bottom view of FIG. 3.

FIG. 5 is a bottom view of FIG. 3. A plurality of endless positioning grooves (39) are provided at the bottom wall of the tool rack (10) illustrated in FIG. 5 are also connectors (11), coupling rings (12), flat arms (13), first ridged portion (14), second ridged portion (15), first locating rib (19), second locating rib (20), locating grooves (25), neck (26), female locking member—a swinging retaining ring (35) endless positioning grooves (39), a plurality of finger grooves (41), protruding portions (42), recessed area in the bottom wall (43) and hanging holes (44).

Figure 6:
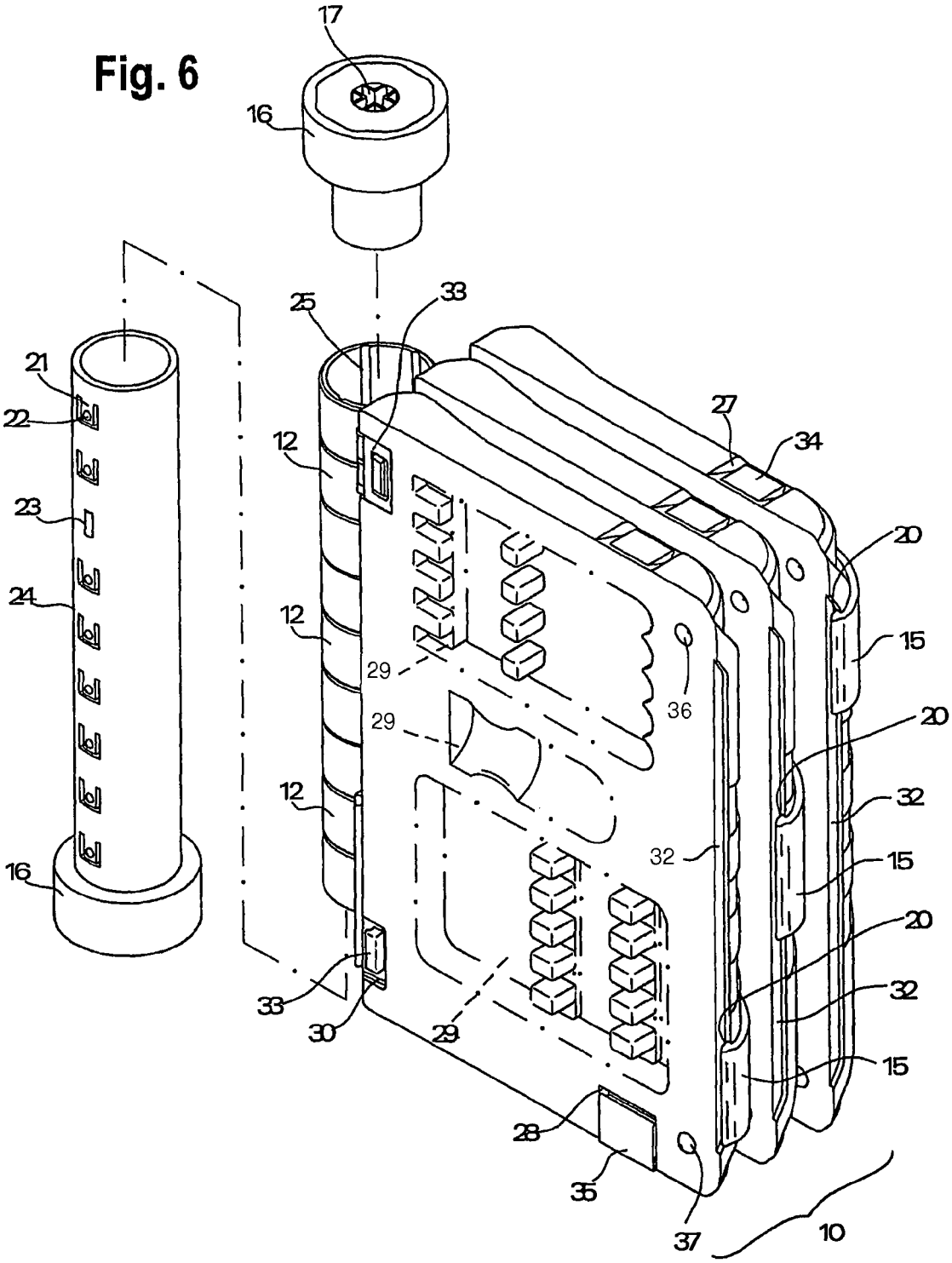
FIG. 6 is an exploded view of the present invention, showing a number of tool racks arranged in a stack thus illustrating the vertical tool rack storage device

FIG. 6 is an exploded view of the present invention showing a number of tool racks (10) arranged in a stack. The coupling rings (12) of each of a number of connectors (11) are respectively coupled to the hollow upright pivot shaft (24) to pivotally connect a number of tool racks (10) to be arranged in a stack. After coupling of the coupling rings (12) of the connectors (11) to the hollow upright pivot shaft (24) two end caps (16) are respectively capped on the two ends of the pivot shaft (24) to stop the coupling rings (12) from escaping out of the pivot shaft (24). Each end cap (16) has an axially extended plughole (17) for fastening to an upright support to hold the vertical took rack storage device in place.

The hollow upright pivot shaft (24) has a plurality of spring strips (21) axially aligned in a line. The spring strips (21) each have one end, namely, the fixed end formed integral with the peripheral wall of the hollow upright pivot shaft (24) and the other end, namely, the free end provided with a raised portion (22) having a semispherical shape. The coupling ring (12) of each connector (11) has a plurality of locating grooves (25) equiangularly spaced around the inside wall and extending in axial direction for receiving the raised portion (22) of each of a number, for example, two adjacent spring strips (21) to hold the respective connector (11) in position relative to the hollow upright pivot shaft (24).

In FIG. 6 also are illustrated a plurality of recessed portions (30) retaining blocks (33) female locking members—a swinging retaining ring (35), a raised locating portion (37), a recessed portion (28), a second ridged portion (15) locating grooves (32), second locating rib (20), a male retaining block (34), a recessed portion (27), a swinging retaining ring (31), one rib (23).

Figure 7:
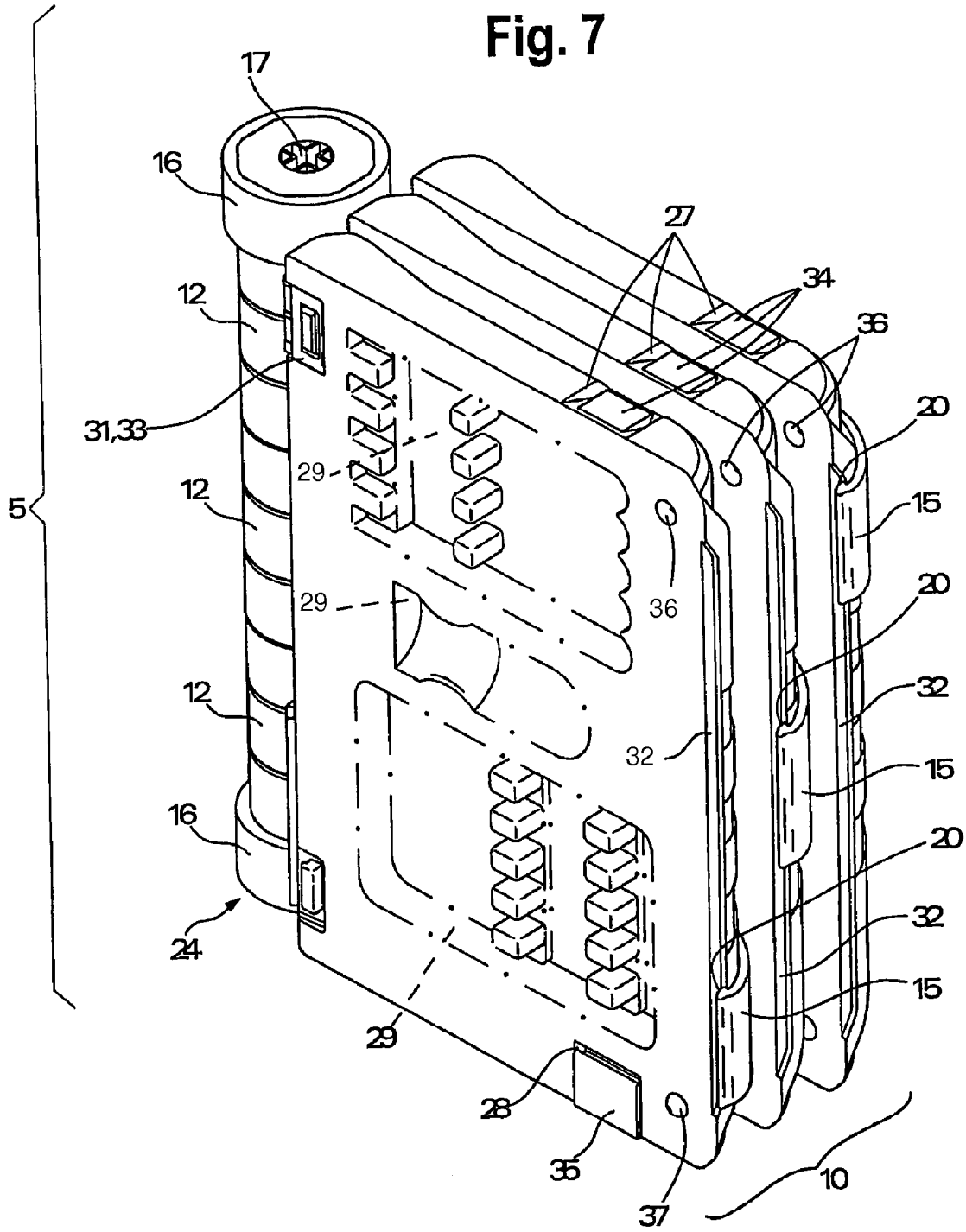
FIG. 7 is an assembly view of the tool rack storage device shown in FIG. 6.
Figure 8:
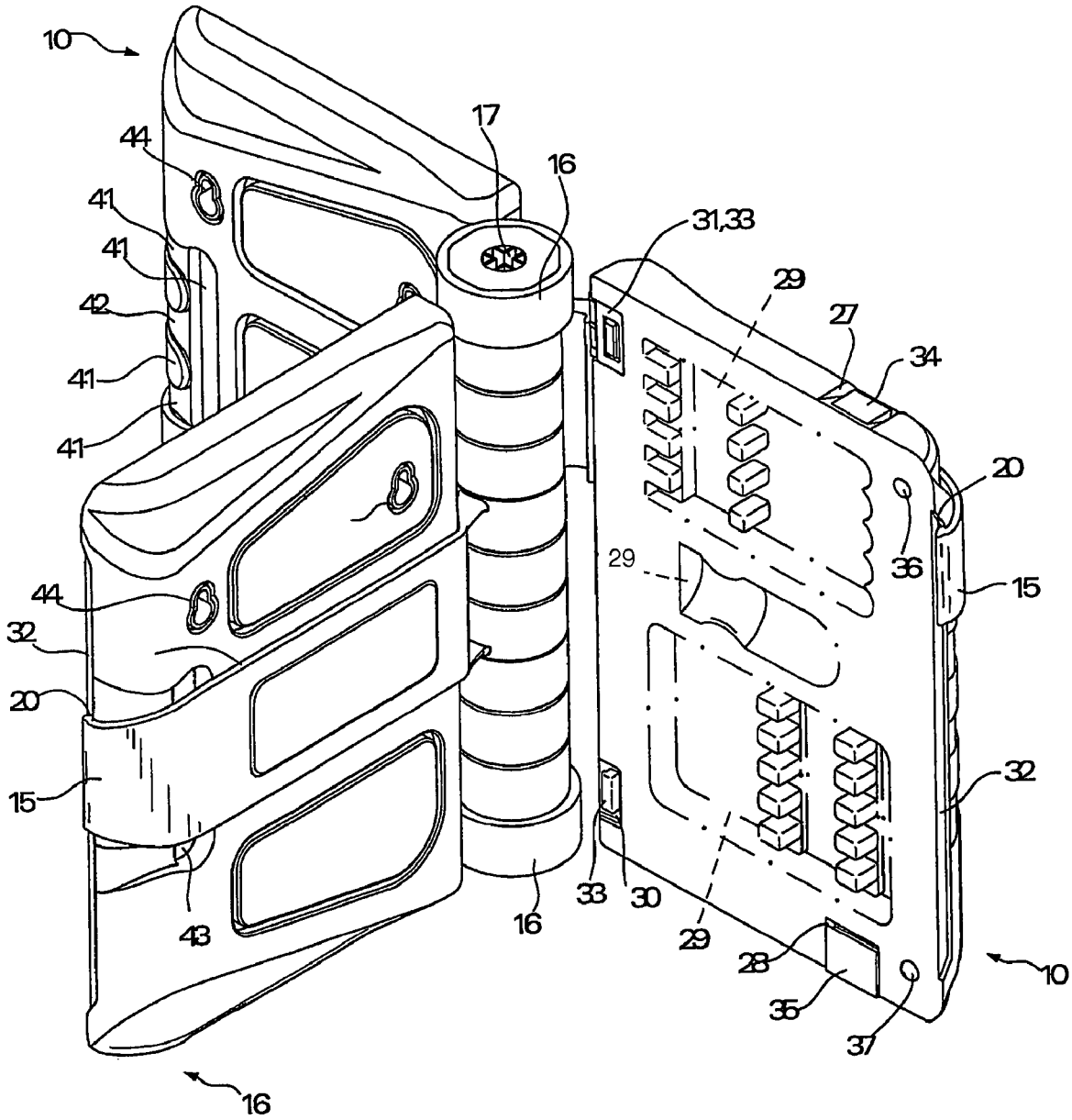
FIG. 8 is an elevational view of the present invention showing the tool racks of the tool rack storage device turned apart from one another.

FIG. 7 is an assembly view of the vertical tool rack storage device shown in FIG. 6 and FIG. 8 is an elevational view of the present invention showing the tool racks (10) of the vertical tool rack storage device turned apart from one another.

In the event the swinging retaining rings (31) and (35) of the tool racks (10) are maintained in the extended status they will interfere with the connection of the connectors (11) to the tool racks (10). Therefore, the retaining rings (31) and (35) can be turned inwards and hooked in the retaining blocks (33) and (40) in the respective recessed portions (30) and (28) (each tool rack (10) has a retaining block (40) in the recessed portion.) In FIGS. 7 and 8 also are shown a plurality of recessed portions (15), locating grooves (32), the second locating rib (20), a recessed locating hole, a male retaining block (34), recessed portion (27), a plughole (17), end caps (16), locating grooves (12), hollow upright pivot shaft (24), a plurality of tool bit compartments (29), recessed portion (28), a female locking member—a swinging retaining ring (35), a raised locating portion (37), flat arms (13), a plurality of finger grooves (41), protruding portions (42) and hanging holes (44).

Figure 9:
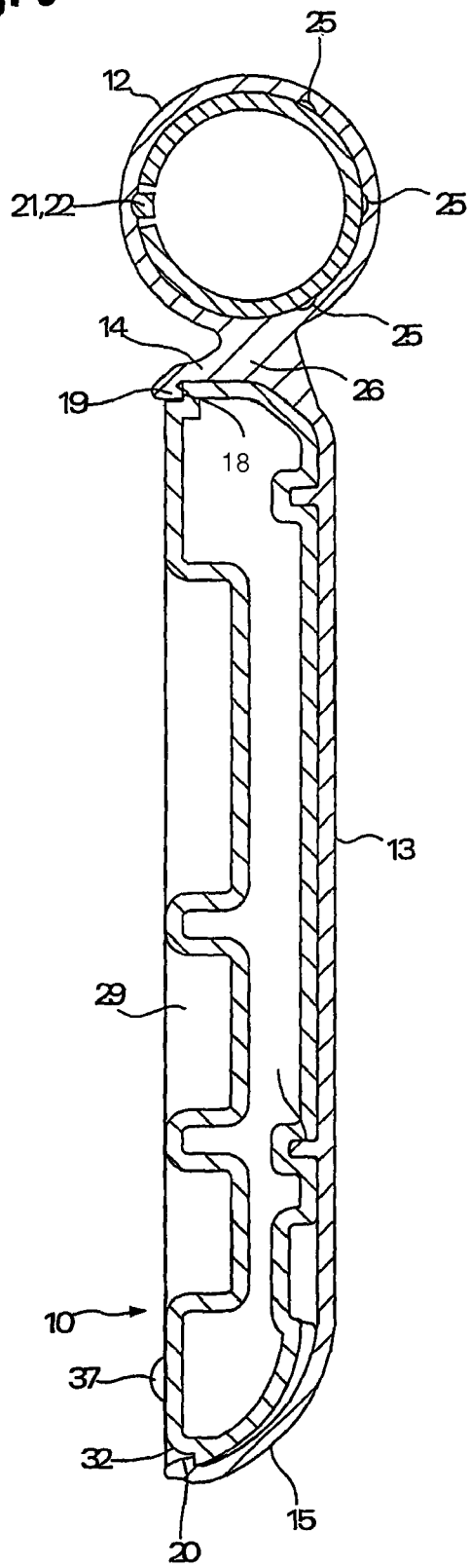
FIG. 9 is a sectional view of a part of the present invention, showing one tool rack fastened to one connector.

FIG. 9 is a sectional view of a part of the present invention showing one tool rack (10) fastened to one connector (11). An endless protruding positioning portion (18) is provided at the flat arm (13) for engaging the endless positioning groove (39). The tool rack (10) is positively secured to the flat arm (13) by engaging the endless protruding positioning portion (18) and the first locating rib (19) and second locating rib (20) into the endless positioning groove (39) and the locating grooves (38) and (39).

Also shown in FIG. 9 are a neck (26), locating grooves (28), coupling rings (12), a free end provided with a raised portion (22), spring strips (21) the first ridged portion (14), a plurality of tool bit compartments (29), a raised locating portion (37) locating grooves (32) and a second ridged portion.

Figure 10:
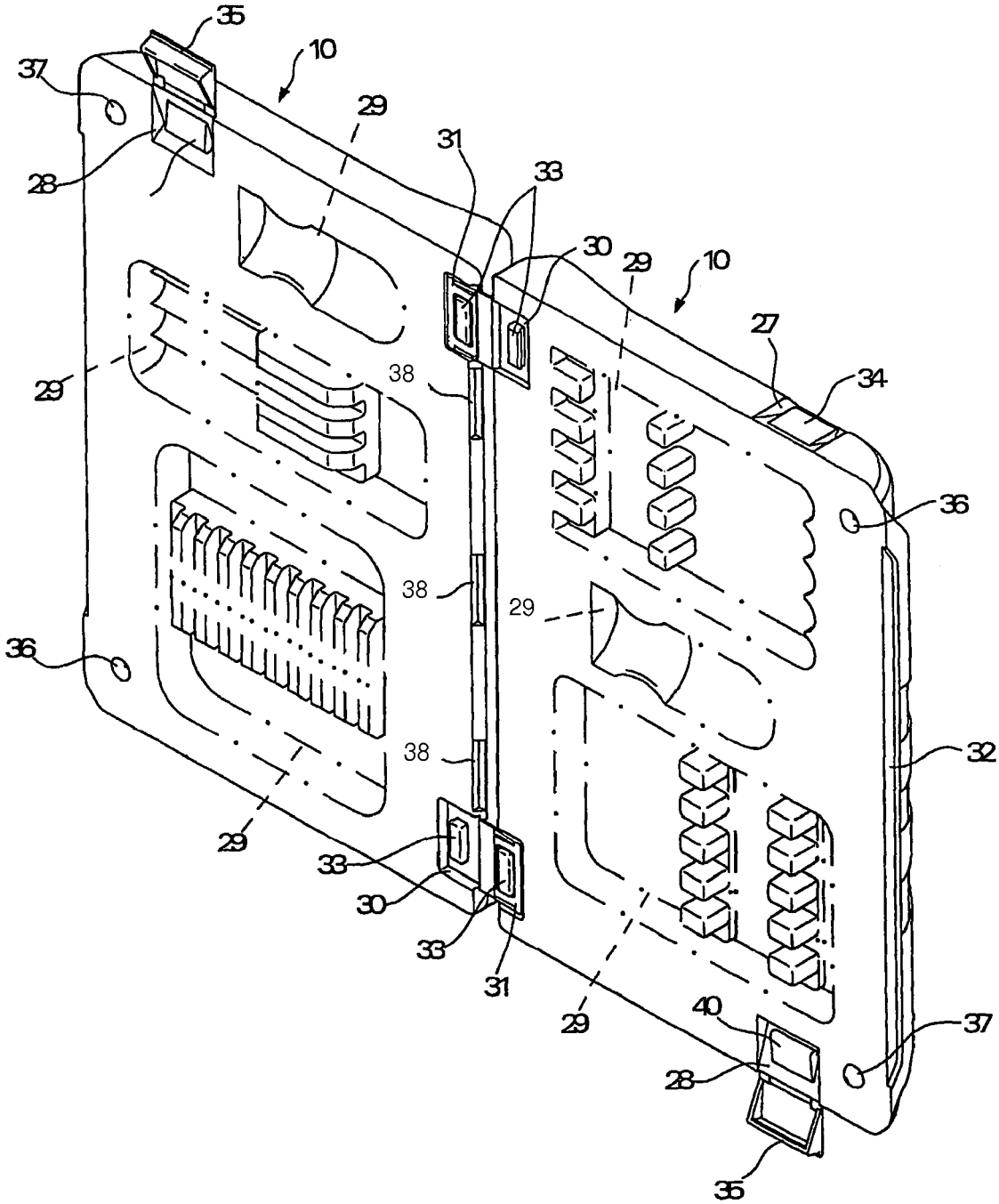
FIG. 10 illustrates two tool racks hinged together and set in the extended position.

FIG. 10 illustrates two tool racks (10) hinged together and set in the extended position.

By means of hooking the swinging retaining rings (31) of one tool rack (10) on the retaining blocks (33), two tool racks (10) are hinged together and can be turned relative to each other between an open and a closed portion. Further a locking structure is provided to lock two hinged tool racks in the close position. Each tool rack (10) comprises two recessed portions (27) a (28) at two opposite peripheral walls thereof, a male locking spring strips (21) each having an end, the fixed end formed integral with the peripheral wall of the hollow upright pivot shaft (24) and the other end, the free end is provided with a raised portion having a peripheral shaft by means of hooking the swinging retaining rings (31) of one tool rack (10) on the retaining blocks (33), two tool racks are hinged together and can be turned relative to each other between an open position and a close position.

A locking structure is provided to lock two hinged tool racks in the close position. Each tool rack (10) comprises two recessed portions (27) and (28) at two opposite peripheral walls thereof, a male locking member, for example, a retaining block (34) disposed in one recessed portion (27) and a female locking member, for example, a swinging retaining ring (35) extended from the other recessed portion (28). When two tool racks (10) are fastened together and closed on each other, the swinging retaining ring (35) one tool rack (10) is hooked on the corresponding retaining block (34) of the other tool rack (10) to lock the two tool racks in the close position.

Each tool rack (10) further comprises a recessed locating hole (36) and a raised locating portion (37) at the top wall. When two tool racks (10) are fastened together and closed on each other, the raised locating portion (37) of one tool rack (10) is engaged into the recessed locating hole (36) of the other tool rack (10) to present relative displacement between the two tool racks.

In FIG. 10 also shows a plurality of took bit compartments, a plurality of recessed portions and a retaining block.

Figure 11:
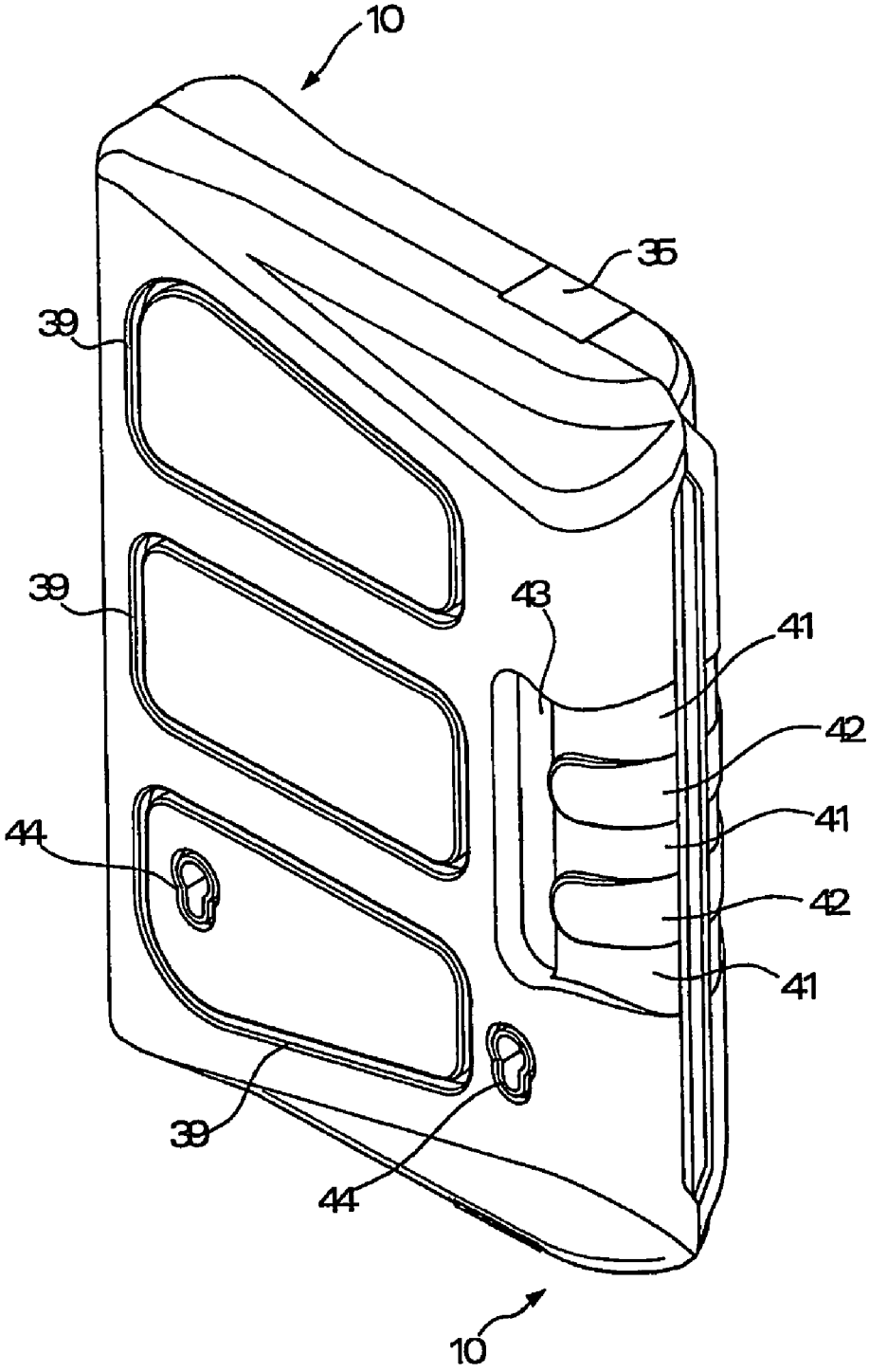
FIG. 11 illustrates the outer appearance of the closed of two hinged tool racks according to the present invention.

FIG. 11 illustrates the outer appearance of the close status of hinged tool racks (10). Two tool racks (10) are fastened together and locked in the closed position. The combination of tool racks (10) is suitably used as a tool case. For easy hand carrying of the tool case, each tool rack (10) has a recessed area (43) and separated from one another by protruding portions (42). Each tool rack (10) has two hanging holes (44) for hanging on upright walls or other upright support means (not shown).

FIGS. 12A and 12B illustrate detachable connecting (48) and detachable fastening structures (45).

In FIG. 12A, the structures are connected by two wires (47). Apertures (46) for connecting the device to the wall are also shown. FIG. 12B illustrates the end caps (16) and connecting structures (48) and the hollow upright pivot shaft (24) without coupling rings, the base (59) of the hollow upright pivot shaft (24) and the hollow top (55) of the hollow upright pivot shaft (24).

FIG. 13 illustrates the connecting and fastening structures (48) and (45). The connecting structure (48) has a plug rod (50) and the fastening structures (45) have two (52) has a front guide face (51). An aperture (46) is shown; this is one of a pair through which the vertical tool rack storage device of this invention is hung on the wall.

FIGS. 14 and 15 illustrate the assembled connecting structure (48) and fastening structure (45) showing plug rod (50), which will be inserted in the end cap (16) through the plughole (17). A pair of apertures (49) for wires is also shown.

Figure 16:
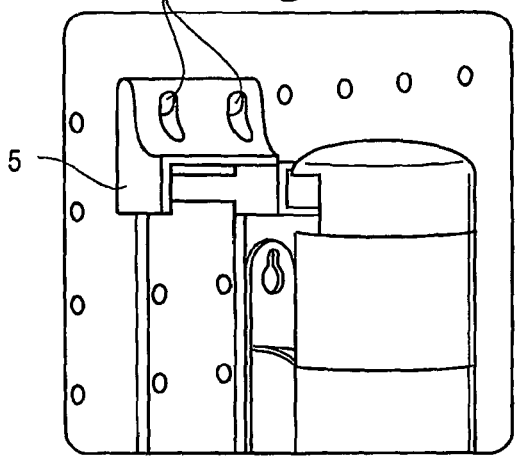
FIG. 16 illustrates the situation where the tool rack storage device has been hinged to the wall.

FIG. 16 illustrates the vertical tool rack storage device of this invention (5) attached to a wall through apertures (46).

Figure 17:
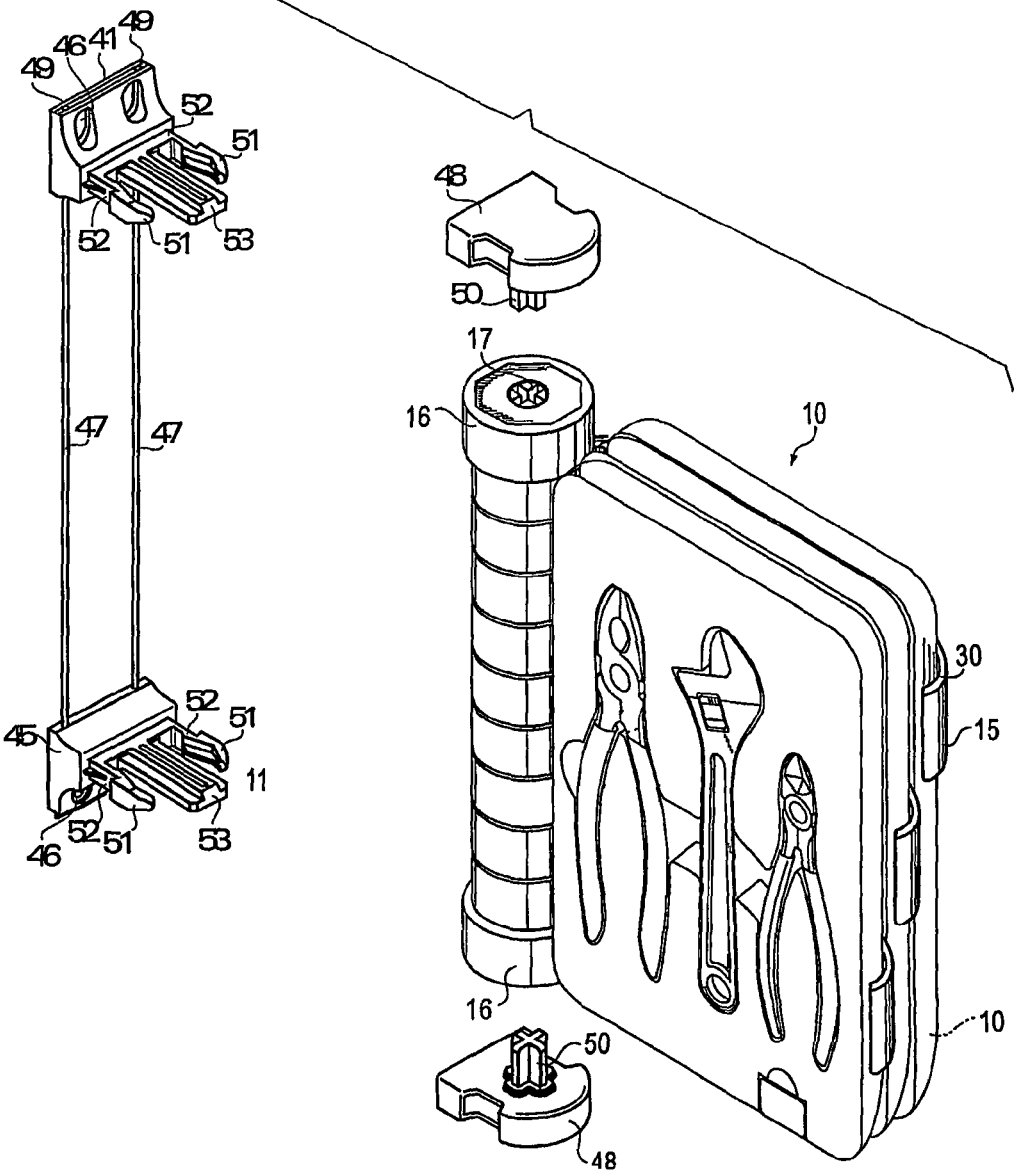
FIG. 17 is the embodiment of the tool rack storage device of this invention showing the hollow upright pivot shaft, three tool racks sleeving the hollow upright pivot shaft through three coupling rings. Also shows apertures of the end cap, connecting structures and fastening structures.

FIG. 17 illustrates the vertical tool rack storage device of this invention (5) coupling rings (12), tool racks (10). Also shown is plughole (17), end cap (16), connecting structure (48) fastening structure (45) and plug rod (50). The fastening structure (45) has two apertures (49) through which, optionally, wire (47) can be inserted. The fastening structure also has two apertures (46) used to fasten the vertical tool rack storage device (5) to a wall. Further more, FIG. 17 illustrates the fastening structure (45), including two spring locking bars (51), center guide shaft (53), two guide faces (51) and the connecting structure (48). A plurality of coupling rings are illustrated.

Figure 19:
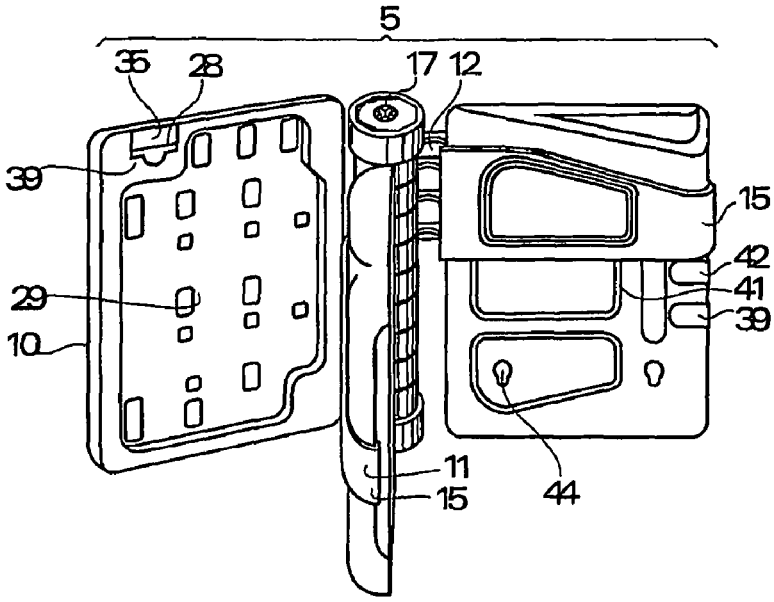
FIG. 19 is another view of the vertical tool rack storage device of this invention.

FIG. 19 illustrates the vertical tool rack storage device (5) of this invention. A tool rack (10) is shown. Position grooves (39) and a female locking member—a swinging retaining ring (35) are illustrated.

A plurality of tool bit compartments 29) are shown.

A connector (11) and a second ridged portion are illustrated. A plughole (17) is shown illustrating the capability of the vertical tool rack storage device to be hanged on the wall if connecting structures (48) and fastening structures (45) are utilized A plurality of finger grooves (41) and protruding portions (42) are illustrated. Hanging holes (44) are also shown.

Figure 20:
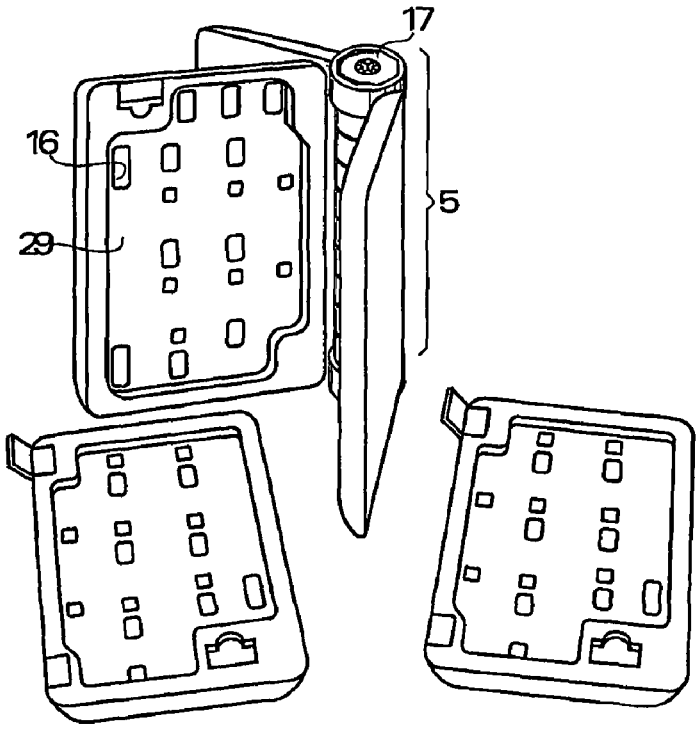
FIG. 20 illustrates the vertical tool rack storage device of this invention with connecting and fastening structures.

FIG. 20 illustrates the vertical tool rack storage device (5) of this invention with detachable fastening structure (45) and detachable connecting structure (48) in place. Also shown are apertures where wire (49) can be drawn, a recessed area (19) in the bottom wall, coupling rings (12), end caps (16), and flat arm (13).

Figure 21:
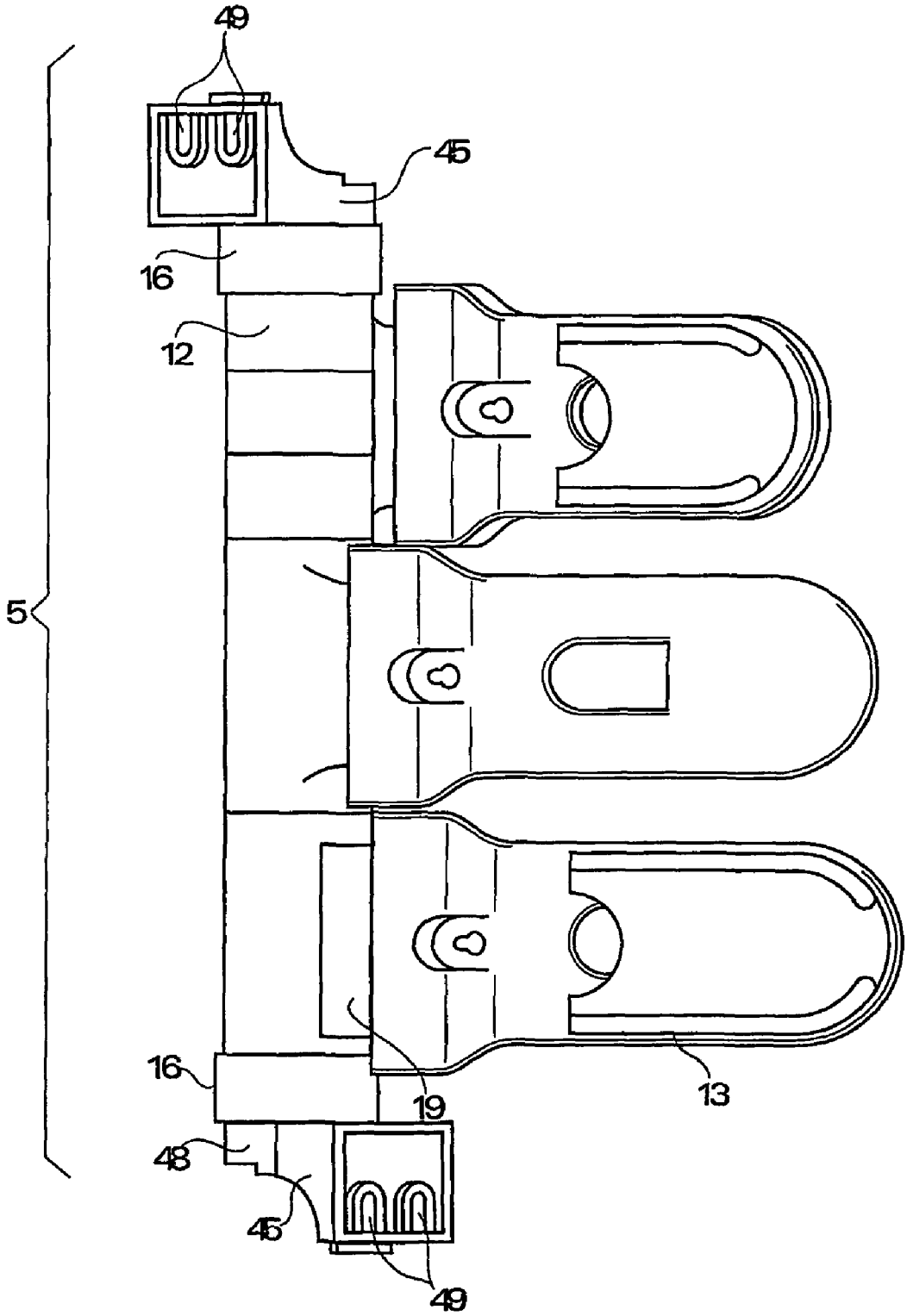
FIG. 21 illustrates the vertical tool rack storage device of this invention wherein the rack is holding large tools.

FIG. 21 illustrates the vertical tool rack storage device (5) of this invention. Three tool racks (10) are shown. Coupling rings (12), end caps (16), plughole (17), flat arm (13) and second ridged portion (15) are also illustrated. The large tools stored in the rack (55) are illustrated. Further illustrated details include a swing retaining ring (35), endless positioning grooves (39), a plurality of finger grooves (41) and protruding portions (42).

endless positioning grooves (39), a plurality of finger grooves (41) and protruding portions (42).

Figure 22:
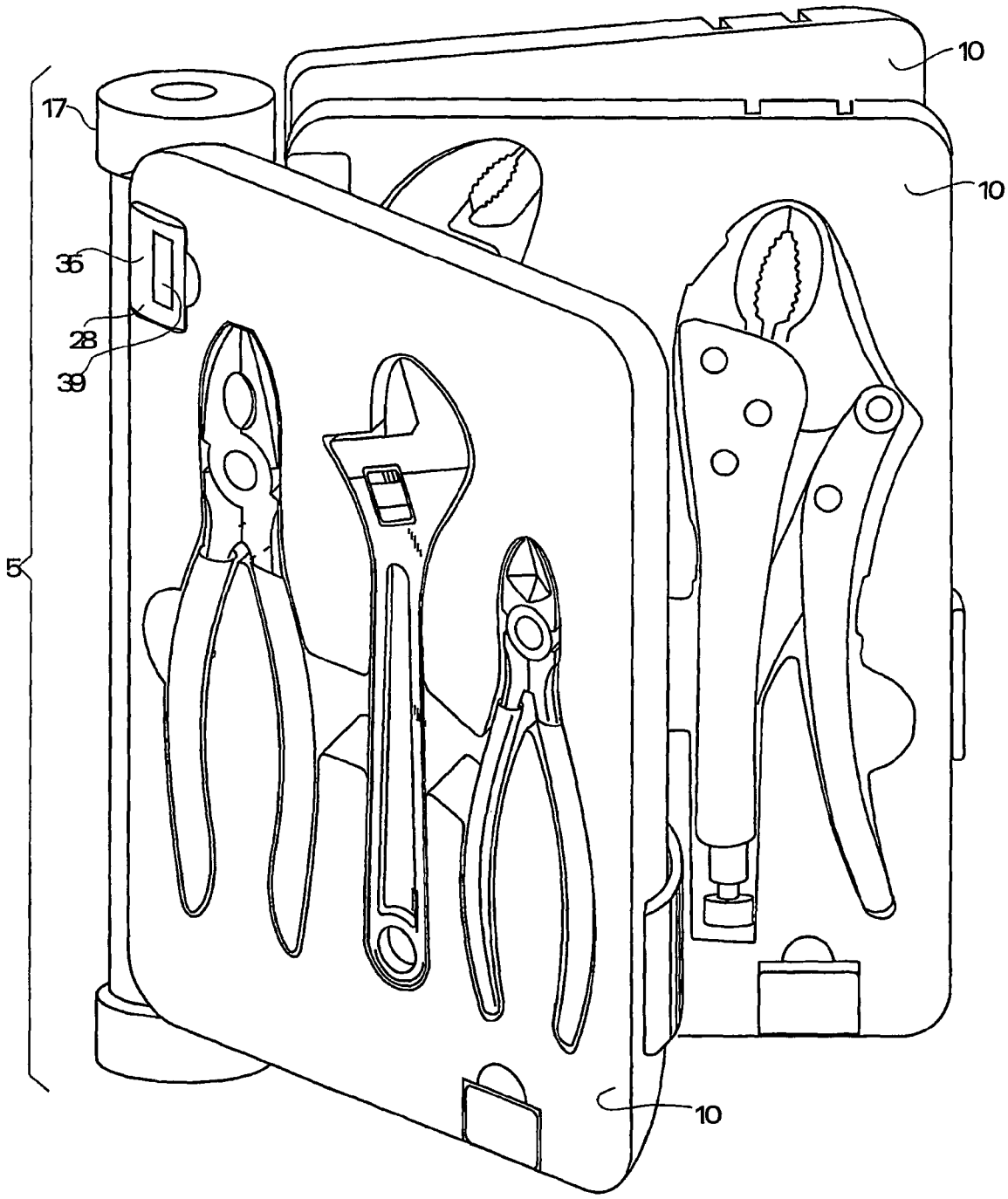
FIG. 22 is another view of FIG. 12.
Figure 23:
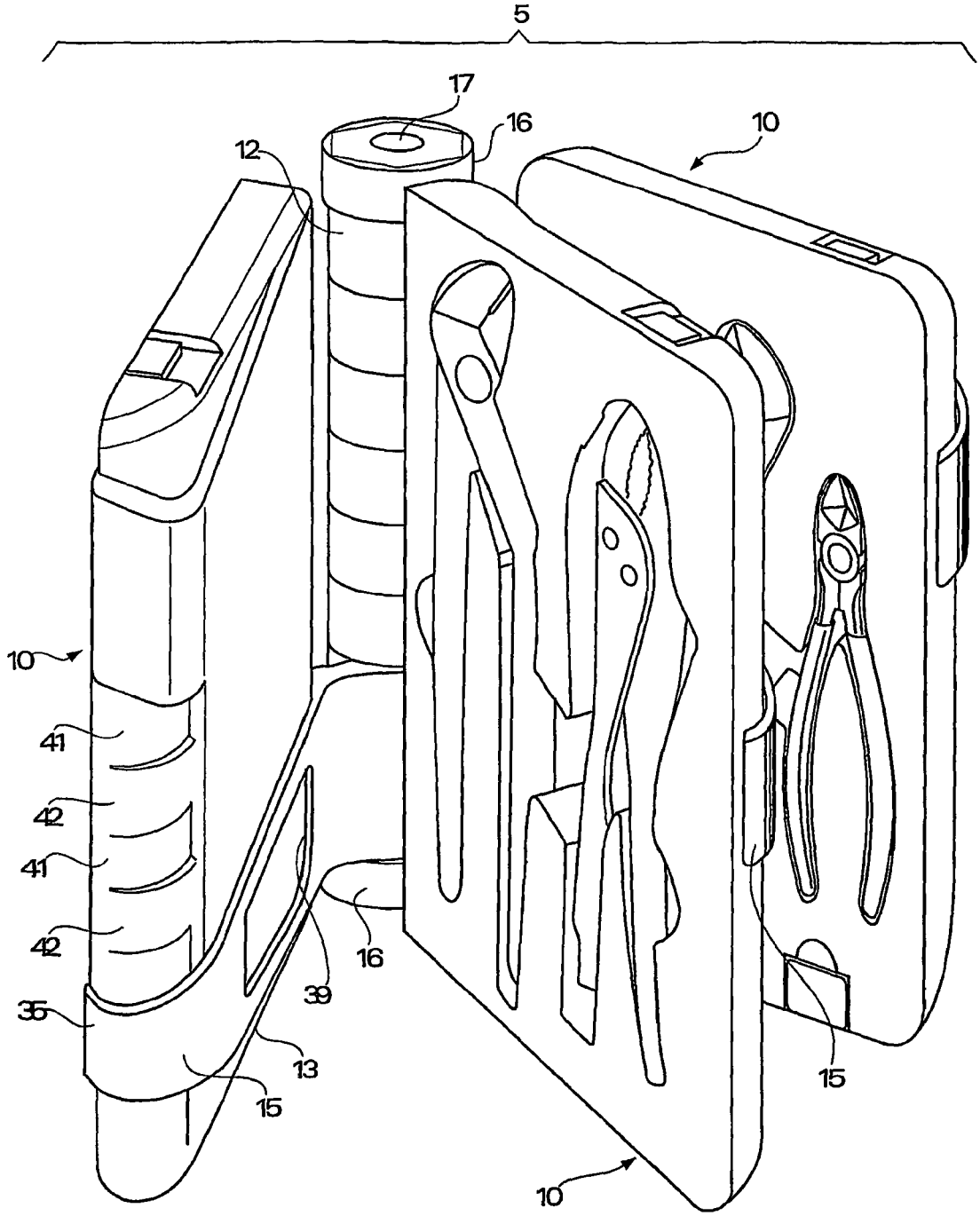
FIG. 23 is a view similar to FIG. 22 with a tool rack pivoted or rotated to illustrate the rear of the tool rack.
Figure 24:
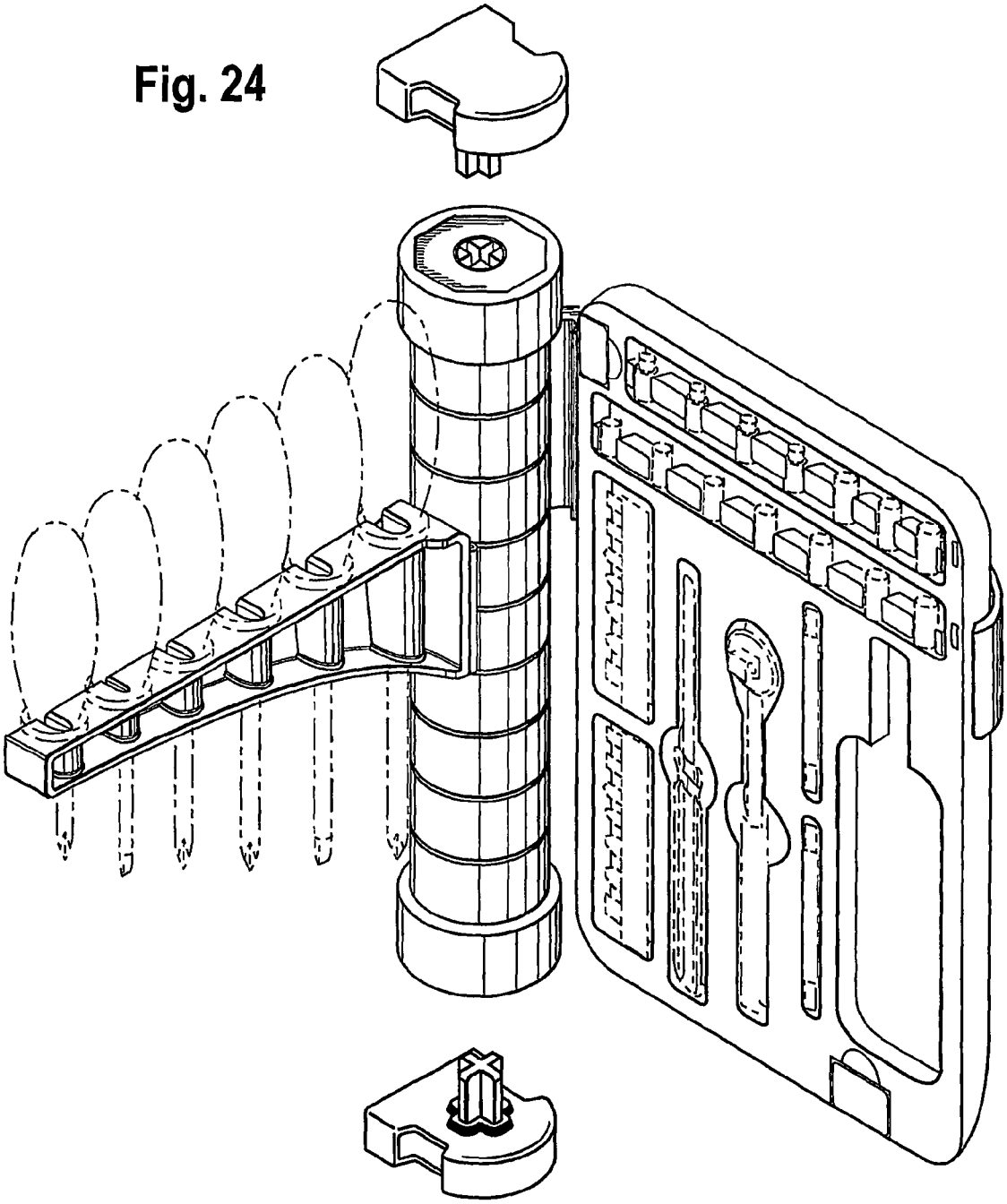
FIG. 24 is a perspective view of the tool rack storage device showing a tool rack and tools in an arm.
Figure 25:
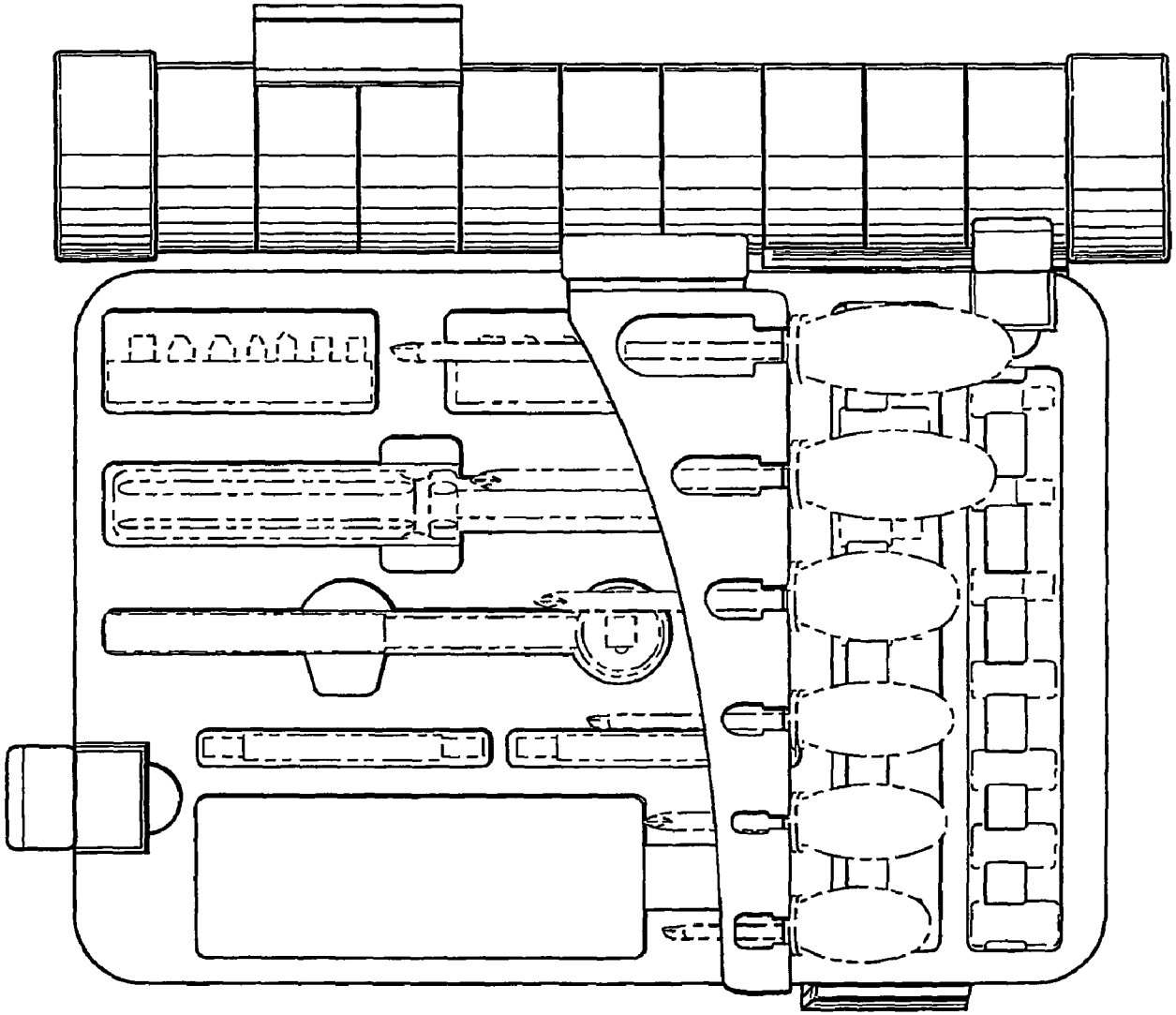
FIG. 25 is a front view of the tool rack storage device of FIG. 24.

FIG. 22 is similar to FIG. 21 and illustrates the vertical tool rack storage device of this invention (5) including three racks (10), the tools (55) held in those racks (55), end caps (16), plughole (17), mail recessed portion (28), female locking member, a swing retaining ring (35) and endless positioning grooves (39).

Various modifications to the invention are contemplated. It is understood, therefore, that within the scope of the appended claims, the invention may be practiced otherwise than specifically described.

What is claimed is:

1. A vertical tool rack storage device comprising:

(a) two flat independent tool racks for holding tool bits;

(b) a coupling structure for securing said two flat independent tool racks for allowing said two flat independent tool racks to be positioned relative to each other between an open position and a closed position; and (c) a locking structure for locking said two flat independent tool racks in said closed position, wherein the two flat independent tool racks are separable from and joinable to one another and, when joined to one another, are positionable relative to each other between the open position and the closed position, and wherein said coupling structure comprises a first recessed portion and a second recessed portion respectively, provided at the border of one side of each said flat independent tool rack, a retaining block disposed in said first recessed portion, and a swinging retaining ring extending from said second recessed portion in such a manner that the swinging retaining ring at one said flat independent tool rack can be connected on the retaining block in the first recessed portion at the other flat independent tool rack.

2. The vertical tool rack storage device of claim 1 wherein said locking structure comprises a male locking member and a female locking member respectively provided at two opposite sides of each said flat independent tool rack for enabling said two flat independent tool racks to be locked in said closed position by fastening the male locking member at one of said two flat independent tool racks to the female locking member at the other of said two flat independent tool racks.

3. The vertical tool rack storage device of claim 2 wherein said male locking member is a retaining block and said female locking member is a swinging ring.

4. The vertical tool rack storage device of claim 1 wherein each said flat independent tool rack has at least one recessed locating hole and at least one raised locating portion arranged in a top wall thereof, said flat independent tool racks can be attached together by engaging at least one raised locating portion at one of said flat independent tool racks into at least one recessed locating hole on the other of said flat independent tool racks.

5. The vertical tool rack storage device of claim 1 wherein each said flat independent tool rack has at least one hanging hole for hanging.

6. A vertical tool rack storage device, comprising:

(a) two flat independent tool racks for holding tool bits;

(b) a coupling structure for securing said two flat independent tool racks for allowing said two flat independent tool racks to be positioned relative to each other between an open position and a closed position; and (c) a locking structure for locking said two flat independent tool racks in said closed position, wherein the two flat independent tool racks are separable from and joinable to one another and, when joined to one another, are positionable relative to each other between the open position and the closed position, and wherein each said flat independent tool rack has a recessed area in a bottom wall thereof, a plurality of protruding portions spaced from one another in said recessed area, and a plurality of finger grooves formed in said recessed area and separated from one another by said protruding portions.

* * * * *